US012760635B2

(12) United States Patent
Ba et al.

(10) Patent No.: US 12,760,635 B2
(45) **Date of Patent: *Oct. 13, 2026**

(54) SYSTEMS AND METHODS FOR DETERMINING DOWNHOLE TOOL STATUS

(71) Applicant: Schlumberger Technology Corporation, Sugar Land, TX (US)

(72) Inventors: Samba Ba, Houston, TX (US); Mustapha Rhazaf, Abingdon (GB); Qiuhua Liu, Houston, TX (US); Prateek Goel, Houston, TX (US); Jinsoo Kim, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/546,521

(22) Filed: Feb. 23, 2026

(65) Prior Publication Data

US 2026/0185440 A1 Jul. 2, 2026

Related U.S. Application Data

(63) Continuation of application No. 18/598,011, filed on Mar. 7, 2024, now Pat. No. 12,560,074, which is a continuation of application No. 18/585,127, filed on Feb. 23, 2024, now Pat. No. 12,560,073.

(51) Int. Cl.
*E21B 44/00* (2006.01)
*E21B 47/12* (2012.01)

(52) U.S. Cl.
CPC ..... *E21B 44/00* (2013.01); *E21B 47/12* (2013.01)

(58) Field of Classification Search
CPC ..... E21B 44/00; E21B 47/12
See application file for complete search history.

(56) References Cited

U.S. PATENT DOCUMENTS

| | | | | |
|---|---|---|---|---|
| 2012/0285701 | A1 | 11/2012 | Cheng | |
| 2014/0032192 | A1 | 1/2014 | Zamora | |
| 2019/0353023 | A1* | 11/2019 | Whitacre | E21B 47/024 |
| 2020/0125225 | A1 | 4/2020 | Bettles | |
| 2020/0277847 | A1* | 9/2020 | Rojas | E21B 44/00 |
| 2020/0310389 | A1* | 10/2020 | Han | G05B 19/4183 |
| 2021/0140313 | A1 | 5/2021 | Busetti | |
| 2021/0301639 | A1* | 9/2021 | Fidjestoel | G05B 23/027 |
| 2021/0363872 | A1* | 11/2021 | Jamison | E21B 33/13 |
| 2021/0405232 | A1 | 12/2021 | LeBlanc | |
| 2022/0145746 | A1* | 5/2022 | Sadlier | E21B 44/00 |
| 2022/0333443 | A1* | 10/2022 | Groover | E21B 4/02 |
| 2023/0025599 | A1* | 1/2023 | Fox | E21B 17/0283 |
| 2023/0028108 | A1* | 1/2023 | Chen | E21B 10/00 |

(Continued)

*Primary Examiner* — Amine Benlagsir
(74) *Attorney, Agent, or Firm* — Kyle R. Miiller

(57) ABSTRACT

A system and method is disclosed for monitoring a downhole tool in a wellbore using downlink definitions. In some embodiments, the method includes receiving a tool status indicating a current operation mode and one or more operating parameters. Multiple sets of downlink definitions share a set of downlink identifiers (IDs) that define the same downlink IDs to different downlink commands based on the operation mode. Downlink IDs may be transmitted as surface downlinks that indicate for the downhole tool to implement certain downlink commands, which are identified by the downhole tool based on the operation mode of the downhole tool.

20 Claims, 10 Drawing Sheets

(56) References Cited

U.S. PATENT DOCUMENTS

| | | | | |
|---|---|---|---|---|
| 2023/0038752 | A1* | 2/2023 | Hamzah | E21B 47/26 |
| 2023/0193750 | A1* | 6/2023 | Pogrebinsky | E21B 47/18 367/82 |
| 2023/0392446 | A1* | 12/2023 | Hay | E21B 41/0085 |
| 2024/0309755 | A1* | 9/2024 | Sosareyes | E21B 44/005 |

* cited by examiner 340-1

350

342

OPERATION MODE: BUILD AND TURN

| Downlink ID *344* | Downlink Command *346* | Bit Pattern *348* |
|---|---|---|
| 1-0 | TF = 0°, SR=25% | 10110010 |
| 1-1 | TF = 0°, SR=50% | 10010011 |
| 1-2 | TF = 0°, SR=75% | 10101100 |
| 1-3 | TF = 0°, SR=100% | 01010010 |
| 1-4 | TF = 18°, SR=75% | 10100101 |
| 2-1 | TF = 18°, SR=100% | 11100100 |
| 2-2 | TF = 36°, SR=50% | 00101101 |
| 2-3 | TF = +6° | 10110101 |
| 2-4 | TF = -6° | 01101010 |
| . | . | . |
| . | . | . |
| . | . | . |
| 2-20 | Set Build and Turn Mode | 11010110 |
| . | . | . |
| . | . | . |
| . | . | . |

FIG. 3-1

340-2

350

342

OPERATION MODE: HIA

| Downlink ID *344* | Downlink Command *346* | Bit Pattern *348* |
|---|---|---|
| 1-0 | Target Inc. = +0.1° | 10110010 |
| 1-1 | Target Inc. = +0.2° | 10010011 |
| 1-2 | Target Inc. = +0.5° | 10101100 |
| 1-3 | Target Inc. = -0.1° | 01010010 |
| 1-4 | Target Inc. = -0.2° | 10100101 |
| 2-1 | Target Inc. = -0.5° | 11100100 |
| 2-2 | Target Azi. = +0.1° | 00101101 |
| 2-3 | Target Azi. = +0.2° | 10110101 |
| 2-4 | Target Azi. = +0.5° | 01101010 |
| . | . | . |
| . | . | . |
| . | . | . |
| 2-21 | Set HIA Mode | 11010110 |
| . | . | . |
| . | . | . |
| . | . | . |

FIG. 3-2

SYSTEMS AND METHODS FOR DETERMINING DOWNHOLE TOOL STATUS

RELATED APPLICATIONS

This application is a continuation and claims the benefit of, U.S. application Ser. No. 18/598,011, filed on 7 Mar. 2024, now U.S. Pat. No. 12,560,074, which is a continuation and claims the benefit of and priority to U.S. application Ser. No. 18/585,127, filed on 23 Feb. 2024, now U.S. Pat. No. 12,560,073, each of which is incorporated by reference herein in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Downhole tools implemented within wellbores may be controlled based on downlink signals sent to the downhole tool from the surface of the wellbore. Due to the large depths at which downhole tools often operate, communication between the downhole tool and surface equipment may be limited, slow, and subject to reliability issues. As such, it may be difficult to know and confirm an operational status of the downhole tool. For example, information may be communicated to the surface from downhole tools through downhole telemetry techniques, but in many cases, downhole telemetry data received at the surface may be incomplete, may include noise, may be unavailable, or may otherwise be unreliable. Thus, improved techniques for determining the status of a downhole tool may be advantageous.

SUMMARY

According to one aspect, a method of operating a downhole tool implemented in a wellbore includes receiving a status of the downhole tool indicating an operation mode and one or more operation parameters for the downhole tool, wherein the status indicates that the operation mode is a first operation mode, and wherein the operation mode of the downhole tool relates to the downhole tool performing downhole operations based on the one or more operation parameters. The method includes identifying a plurality of sets of downlink definitions for which the downhole tool is configured to communicate, the plurality of sets of downlink definitions. The plurality of sets of downlink definitions includes a first set of downlink definitions that define, for a set of downlink identifiers (IDs), a first set of downlink commands for the first operation mode of the downhole tool, wherein the first operation mode is associated with performing a first downhole operation with the downhole tool. A second set of downlink definitions define, for the set of downlink IDs, a second set of downlink commands for a second operation mode of the downhole tool, the second set of downlink commands being different than the first set of downlink commands, wherein the second operation mode is associated with performing a second downhole operation with the downhole tool. The method further includes identifying a first downlink ID for sending from a surface of the wellbore to the downhole tool that indicates a first downlink command for the downhole tool to change the operation mode from the first operation mode to the second operation mode, and transmitting the first downlink ID as a first surface downlink from the surface of the wellbore to the downhole tool by modulating one or more surface parameters. The method includes identifying, from the second set of downlink definitions, a target downlink ID of the set of downlink IDs for sending from the surface of the wellbore to the downhole tool, the target downlink ID indicating a target downlink command for the downhole tool to implement for performing the second downhole operation, wherein, in the first set of downlink definitions, the target downlink ID indicates a different downlink command for the first operation mode than target downlink command for the second operation mode. The method also includes transmitting the target downlink ID as a target surface downlink from the surface of the wellbore to the downhole tool by modulating the one or more surface parameters. In some embodiments, the method is performed by a computer system. In some embodiments, the method is performed as instructions stored on a computer-readable storage medium.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 illustrates an example environment in which a status detection system is implemented, according to at least one embodiment of the present disclosure;

FIG. 2-2 illustrates an example implementation of a status detection system as described herein, according to at least one embodiment of the present disclosure;

FIG. 3-1 illustrates an example set of downlink definitions associated with a downhole tool, according to at least one embodiment of the present disclosure;

FIG. 3-2 illustrates an example set of downlink definitions associated with a downhole tool, according to at least one embodiment of the present disclosure;

FIG. 4-1 illustrates example features and functionality of a downlink detection module, according to at least one embodiment of the present disclosure;

FIG. 4-2 illustrates example features and functionality of a downlink confirmation manager, according to at least one embodiment of the present disclosure;

DETAILED DESCRIPTION

Figure 1:
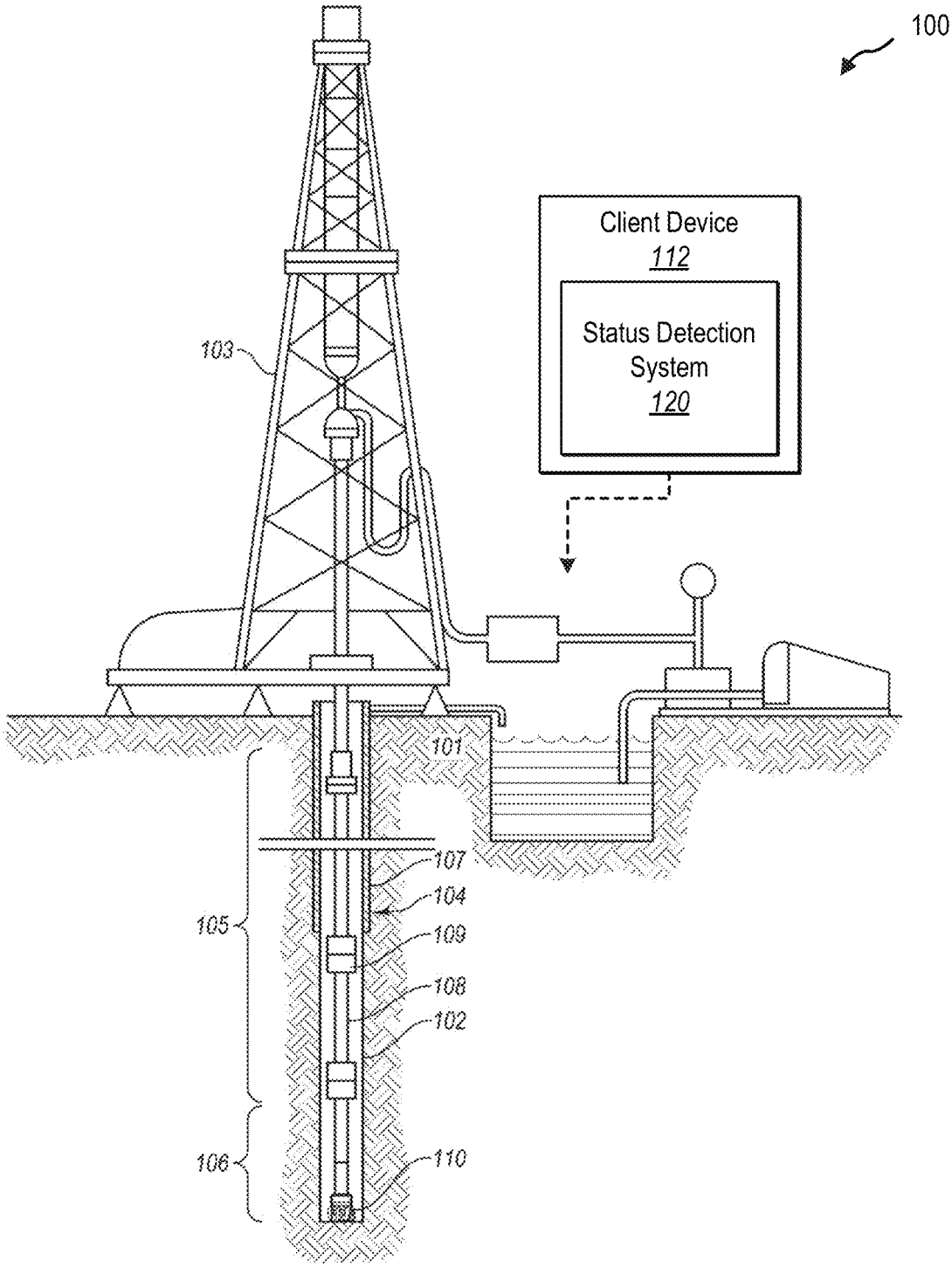
FIG. 1 is an example of a downhole system, according to at least one embodiment of the present disclosure.

This disclosure generally relates to systems and methods for determining a status of a downhole tool. A downhole tool may be implemented in a wellbore, and communication with the downhole tool may be accomplished by sending signals through surface parameters provided to the downhole tool from equipment at the surface of the wellbore. For example, bit patterns may be encoded into surface parameters such as flow rates, pressures, and/or RPMs by modulating these parameters. The downhole tool may detect the modulations and, in this way, receive information from the surface.

In some cases, downlinks may be sent to downhole tools in this manner to instruct the downhole tool how to operate. For example, downlinks may be used to communicate downlink commands to the downhole tool instructing the downhole tool to implement a specific operation mode and/or specific operation parameters. The downhole tool may communicate various information to the surface through downhole telemetry. For example, the downhole tool may communicate one or more data channels that may indicate information such as current operation parameters implemented by the downhole tool, a current operation mode implemented by the downhole tool, and an associated downlink ID that the downhole tool is executing. In some cases, the downhole telemetry data may not be available, or may otherwise not be relied upon to accurately determine the status of the downhole tool.

A computer implemented status detection system may facilitate determining the downhole tool status based on various techniques. The status detection system may monitor the surface parameters and may detect when a downlink is being sent to the downhole tool through the surface parameters. Based on the downlink, the status detection system may determine the associated operation mode and operation parameters that the downlink is instructing the downhole tool to implement. The status detection system may determine the status of the downhole tool to be the operation mode and operation parameters of the downlink based on confirming that the downhole tool received the downlink. For example, the status detection system may compare the information of the downhole telemetry data channels and compare it to an expected behavior of the downhole tool indicated by the downlink. The downlink may be confirmed in this way based on the downhole telemetry data being consistent with what is indicated in the downlink, and in some cases, the downlink may be advantageously confirmed based on only some of the downhole telemetry data, for instance, in situations where some of the downhole telemetry data is not available or otherwise not reliable. In this way, the status detection system may accurately determine the status of the downhole tool.

As will be discussed in further detail below, the present disclosure includes a number of practical applications having features described herein that provide benefits and/or solve problems associated with determining the status of a downhole tool. Some example benefits are discussed herein in connection with various features and functionalities provided by a status detection system implemented on one or more computing devices. It will be appreciated that benefits explicitly discussed in connection with one or more embodiments described herein are provided by way of example and are not intended to be an exhaustive list of all possible benefits of the status detection system.

For instance, in many cases wellbores may extend many miles below the surface of the earth, and downhole tools may therefore be located a significant distance from equipment at the surface of the wellbore. As such, communication with the downhole tool may be difficult, slow, and rudimentary. For example, many downhole tools communicate by sending and receiving signals through mud pulses encoded into a flow of drilling mud. Thus, downhole system may often be selective about the type and amount of information that is transmitted to and from the downhole tool. Despite this, it may be advantageous and, in some cases even necessary, to establish communication with the downhole tool in order to instruct the tool how to operate and to determine various aspects of the tool such as a location, orientation, position, current operation, etc. The status detection system described herein may facilitate accurately determining the status of a downhole tool, which may facilitate properly executing operations of the downhole tool as well as planning for further operations.

For example, the status detection system can determine which commands have been sent to the downhole tool and can identify how the downhole tool has been instructed to behave based on identifying downlinks sent from the surface. The status detection system may infer that the downhole tool is in accordance with these commands, but only after having confirmed that the downhole tool, in fact, received the associated downlink. In this way, the status detection system can accurately conclude with confidence that the downhole tool is acting in accordance with the commands that were sent, while eliminating false positive situations, such as cases where the commands were sent but never received and/or implemented by the downhole tool.

Further, while downhole tools may communicate information to the surface which may often include indications of the tool's status, these communications may not always be available, or may become unreliable in some instances. The status detection system does not rely on the downhole tool reporting its own status, but rather determines the status based on the command that has been sent to the downhole tool. Additionally, the status detection system verifies that the command has been received and implemented by the downhole tool in order to accurately determine the status, and does so based on data channels received from the downhole tool, which in some cases may be limited. For instance, the status detection system may verify based on comparing some (or any available) data communication received from the downhole tool and in some cases may verify based on limited information or a single data channel. In this way, the status detection system may automatically determine the downhole tool status, and may do so accurately despite communications from the downhole tool being intermittent, incomplete, or otherwise unreliable.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. Examples of additional downhole tools include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may be implemented to direct the bit 110 in accordance with or based on a trajectory for the bit 110. For example, a trajectory may be determined for directing the bit 110 toward one or more subterranean targets such as an oil or gas reservoir. The RSS may be controlled in accordance with commands or instructions, for example, transmitted to the RSS via downlinks from the surface of the wellbore. Through downhole telemetry techniques, the RSS may communicate various information back to the surface.

The downhole system 100 may include or may be associated with a client device 112 with a status detection system 120 implemented thereon (e.g., implemented on one, several, or across multiple client devices 112). The status detection system 120 may facilitate determining a status of the RSS or, for example, determining whether the RSS is implementing the commands sent through one or more downlinks.

Figures 1, 2:
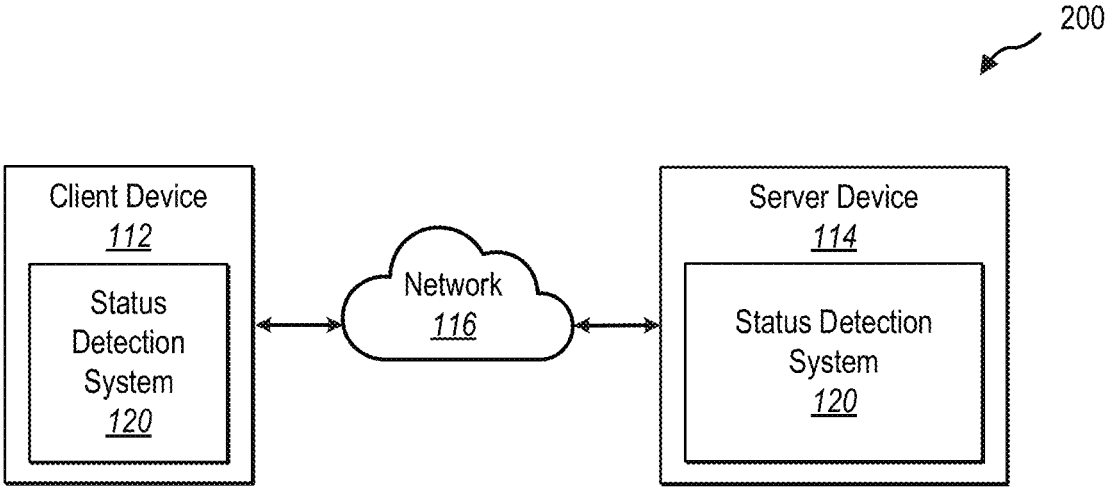
Figure 2:
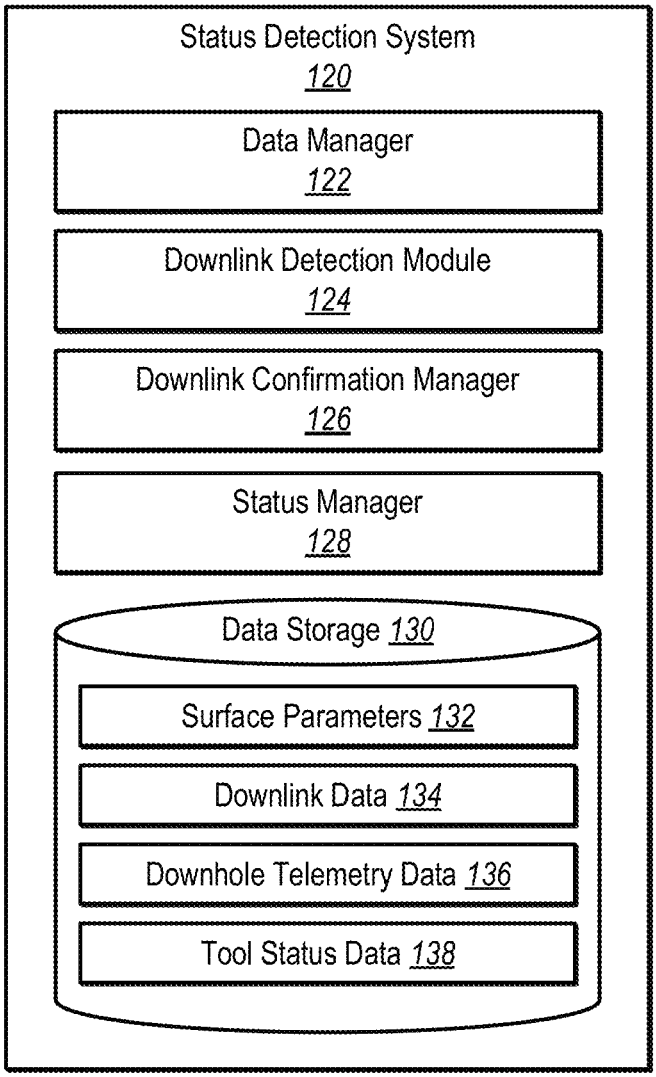

FIG. 2-1 illustrates an example environment 200 in which a status detection system 120 is implemented in accordance with one or more embodiments describe herein. As shown in FIG. 2-1, the environment 200 includes a server device 114. The server device 114 may include one or more computing devices (e.g., including processing units, data storage, etc.) organized in an architecture with various network interfaces for connecting to and providing data management and distribution across one or more client systems. As shown in FIG. 2-1, the server device 114 may be connected to and may communicate with (either directly or indirectly) a client device 112 through a network 116. The network 116 may include one or multiple networks and may use one or more communication platforms and/or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may be representative of one or multiple client devices, and may refer to various types of computing devices. For example, the client device 112 may include a mobile device such as a mobile telephone, a smartphone, a personal digital assistant (PDA), a tablet, a laptop, or any other portable device. Additionally, or alternatively, the client device 112 may include a non-mobile devices such as a desktop computer, server device, surface or downhole processor or computer (e.g., associated with a sensor, system, or function of the downhole system), or other non-portable device. In one or more implementations, the client device 112 includes graphical user interfaces (GUI) thereon (e.g., a screen of a mobile device). In addition, or as an alternative, the client device 112 may be communicatively coupled (e.g., wired or wirelessly) to a display device having a graphical user interface thereon for providing a display of system content. The server device 114 may similarly refer to various types of computing devices. Each of the devices of the environment 200 may include features and/or functionalities described below in connection with FIG. 7.

As shown in FIG. 2-1, the environment 200 may include a status detection system 120 implemented on one or more computing devices. The status detection system 120 may be implemented on one or more of the client device 112, the server device 114, and combinations thereof. Additionally, or alternatively, the status detection system 120 may be implemented across the client devices 112 and/or the server devices 114 such that different portions or components of the status detection system 120 are implemented on different computing devices in the environment 200. In this way, the environment 200 may be a cloud computing environment, and the status detection system 120 may be implemented across one or more devices of the cloud computing environment in order to leverage the processing capabilities, memory capabilities, connectivity, speed, etc., that such cloud computing environments offer in order to facilitate the features and functionalities described herein.

FIG. 2-2 illustrates an example implementation of the status detection system 120 as described herein, according to at least one embodiment of the present disclosure. The status detection system 120 includes a data manager 122, a downlink detection module 124, a downlink confirmation manager 126, and status manager 128. The status detection system 120 may also include a data storage 130 having surface parameters 132, downlink data 134, downhole telemetry data 136 and tool status data 138 stored thereon. While one or more embodiments described herein describe features and functionalities performed by specific components 122-128 of the status detection system 120, it will be appreciated that specific features described in connection with one component of the status detection system 120 may, in some examples, be performed by one or more of the other components of the status detection system 120.

By way of example, one or more of the data receiving, gathering, or storing features of the data manager 122 may be delegated to other components of the status detection system 120. As another example, while surface downlinks may be confirmed by the downlink confirmation manager 126, in some instances, some or all of these features may be performed by the downlink detection module 124 (or other component of the status detection system 120). Indeed, it will be appreciated that some or all of the specific components may be combined into other components and specific functions may be performed by one or across multiple components 122-128 of the status detection system 120.

Additionally, while FIG. 1, for example, depicts the status detection system 120 implemented on a client device 112 of the downhole system, it should be understood that some or all of the features and functionalities of the status detection system 120 may be implemented on or across multiple client devices 112 and/or server devices 114. For example, data may be input and/or received by the data manager 122 on a (e.g., local) client device, and the detection and confirmation of downlinks may be performed on one or more of a remote, server, or cloud device. Indeed, it will be appreciated that some or all of the specific components 122-128 may be implemented on or across multiple client devices 112 and/or server devices 114, including individual functions of a specific component being performed across multiple devices.

As mentioned above, the status detection system 120 includes a data manager 122. The data manager 122 may receive a variety of types of data associated with the downhole system and may store the data to the data storage 130. The data manager 122 may receive the data from a variety of surface and/or downhole sources, such as from sensors, surveying tools, downhole tools, other (e.g., client) devices, libraries, databases, user input, etc.

In some embodiments, the data manager 122 receives surface parameters 132. The surface parameters 132 may include measurements from surface sensors for various parameters of the downhole system. For example, the surface parameters 132 may include measurements associated with the flow of drilling fluid from the surface such as a standpipe pressure, a flowrate, etc. In another example, the surface parameters 132 include measurements associated with the rotational speed of the drill string applied at the surface, such as a surface rotational speed or surface RPM. The data manager 122 may receive surface parameters 132 for any other parameter. As described herein, the surface parameters 132 may facilitate transmitting downlinks to a downhole tool through bit patterns encoded into the surface parameters 132. The data manager 122 may store any of this information to the data storage 130 as surface parameters 132. In some embodiments, the data manager 122 receives and/or stores the surface parameters 132 in real time.

In some embodiments, the downhole tool may be a steering tool, such as an RSS implemented with respect to a BHA of the downhole system. The surface parameters may be supplied to the steering tool in order to facilitate a steering operation of the steering tool, and downlinks may be transmitted to the steering tool through the surface parameters in order to instruct the steering tool how to operate (e.g., to implement steering modes and/or steering parameters). While the status detection system 120 may be primarily described with respect to a steering tool, it should be understood that the techniques described herein may be applicable to any downhole tool for determining a status of the downhole tool based on communications to and from the downhole tool, as described herein.

In some embodiments, the data manager 122 receives downhole telemetry data 136. The downhole telemetry data 136 may be information transmitted from a downhole tool to the surface. For example, the downhole telemetry data 136 may include one or more data channels for relating measurements and/or other information of the downhole tool to the surface. For instance, the data channels may relate a status of the downhole tool. To elaborate, the data channels may relate a downhole downlink or command received or being executed by the downhole tool. Also, the data channels may relate an operation mode and/or a toolface mode of the downhole tool. In another example, the data channels may relate operation parameters or settings that the downhole tool is implementing, such as a toolface angle, steering ratio, target inclination, inclination nudge size, target azimuth, azimuth nudge size, azimuthal steering ratio, dog leg severity, rate of penetration (ROP), or any other operation parameter of the downhole tool, and combinations thereof. The downhole telemetry data 136 may be transmitted to the surface through downhole telemetry techniques such as mud pulse telemetry, electromagnetic telemetry, acoustic telemetry, or wired telemetry, or any other form of long-distance telemetry, and combinations thereof. The data manager 122 may store any of this information to the data storage 130 as downhole telemetry data 136. In some embodiments, the data manager 122 receives and/or stores the downhole telemetry data 136 in real time.

In some embodiments, the data manager 122 receives information related to the capabilities of the downhole tool. For example, the data manager 122 may receive or access a configuration or specification of the downhole tool. The configuration may be associated with a specific type, model, manufacturer, and/or firmware of the downhole tool. The configuration may indicate various operation types or operation modes that the downhole tool may implement. The configuration may indicate various operation parameters for the downhole tool to apply for a given operation mode. In one example, the downhole tool may be configured for a manual or "Build and Turn" mode (e.g., manual steering mode). The "Build and Turn" mode may operate based on operation parameters such as one or more of: a toolface mode (e.g., gravity toolface mode, magnetic toolface mode, etc.), a toolface angle (with respect to a coordinate system defined by the toolface mode), or a steering ratio. The "Build and Turn" mode may be a manual or open loop mode in that the downhole tool may not make automatic adjustments or changes, but rather may operate, for example, in accordance with the specific toolface angle, toolface mode, and steering ratio indicated by the associated operation parameters.

In various examples, the downhole tool may operate in one or more automatic, or closed-loop modes in which the downhole tool may automatically implement changes or adjustments in accordance with the mode and in accordance with associated operation parameters. In one example, the downhole tool may be configured for an automatic vertical mode in which the downhole tool will automatically maintain a vertical or downward orientation. In another example, the downhole tool may be configured for an automatic "inclination hold" (IH) mode in which the downhole tool may maintain a given inclination. The IH mode may operate based on operation parameters such as one or more of: a target inclination, an inclination nudge size, or an azimuthal steering ratio. In another example, the downhole tool may be configured for an automatic "inclination and azimuth hold" (HIA) mode in which the downhole tool may maintain a given inclination and a given azimuth for tangents and laterals. The "HIA" mode may operate based on operation parameters such as one or more of: a target inclination, an inclination nudge size, a target azimuth, or an azimuth nudge size. In another example, the downhole tool may be configured for an automatic "auto curve" (AC) mode in which the downhole tool may automatically execute a curve of a given size and orientation. The "AC" mode may operate based on operation parameters such as one or more of: a dog leg severity or a toolface mode. In this way, the downhole tool configuration may indicate various operations that the downhole tool can perform based on the various modes in which it can operate. The downhole tool may be configured to implement any other operation mode and may be configured to change between different operation modes.

In some embodiments, the configuration may include instructions for communicating with the downhole tool. For example, the downhole tool may be configured to implement certain operation modes and associated operation parameters based on signals or downlinks received by the downhole tool from the surface. The configuration may include a set of downlink definitions that define various downlinks for transmitting to the downhole tool in order to implement and/or change the operation mode and/or operation parameters of the downhole tool.

FIGS. 3-1 and 3-2 illustrate example sets of downlink definitions 340-1 and 340-2 (respectively) associated with a downhole tool, according to at least one embodiment of the present invention. The downlink definitions 340-1 may be associated with an operation mode 350 of "Build and Turn", and the downlink definitions 340-2 may be associated with an operation mode 350 of "HIA."

In some embodiments, the downhole tool may be configured to communicate via a finite number of discrete, unique downlinks 342, such as 32 discrete downlinks, 64 discrete downlinks, 128 discrete downlinks, or any other discrete number of downlinks. The downlinks 342 may be identifiable by a unique downlink ID 344. The downlink ID 344 may be a code or combination of one or more integer numbers that, when received, can be translated (e.g., via the downlink definitions) to indicate an associated downlink command 346. The downlink command 346 may be a specific set of instructions for the downhole tool to implement, such as implementing one or more specific operation parameters or implementing a given operation mode 350. A downlink 342 may be communicated to the downhole tool through an associated bit pattern 348.

In some embodiments, the downlink command 346 for a given downlink 342 may instruct the downhole tool to implement one or more specific operation parameters. For example, as shown in FIG. 3-1, a downlink 342 having a downlink ID 344 of "1-1" may indicate to the downhole tool to implement a toolface angle of 0° and a steering ratio of 50%. As another example, a downlink 342 having a downlink ID 344 of "2-3" may indicate to the downhole tool to increase the toolface angle by 6°. A downlink 342 (and associated downlink command 346) may instruct the downhole tool with respect to any operation parameter for the downhole tool and for any operation mode of the downhole tool. For example, a downlink 342 may instruct the downhole tool to implement a certain inclination angle. As another example, a downlink 342 may instruct the downhole tool to implement a certain dogleg severity. In this way, a downlink 342 may instruct the downhole tool to implement any operation parameters at a specific value, or additionally may indicate to implement a change (e.g., increase or decrease) to any operation parameter and to any degree.

In some embodiments, the downlink command 346 for a given downlink ID 344 may instruct the downhole tool to implement a specific operation mode 350. For example, as shown in FIG. 3-1, a downlink 342 having a downlink ID 344 of "2-20" may indicate to the downhole tool to implement or change to an operation mode 350 of "Build and Turn". A downlink 342 (and associated downlink command 346) may instruct the downhole tool to implement or change to any operation mode 350 as described herein. For example, a downlink 342 may instruct the downhole tool to change to an operation mode 350 of "IH," "HIA," or "AC," or any other operation mode 350 of the downhole tool. In this way, one or more downlinks may be associated with implementing a specific operation mode.

In some embodiments, one or more downlink commands 346 may be specific to, or may be dependent on, the operation mode 350 of the downhole tool. For example, a given downlink ID 344 may be different for different operating modes 350. To elaborate, as shown in FIG. 3-1, when the downhole tool is operating in an operation mode 350 of "Build and Turn," a downlink 342 with a downlink ID 344 of "1-2" may instruct the downhole tool to implement the operation parameters of a toolface angle of 0° and a steering ratio of 75%. As mentioned above, the toolface angle and steering ratio operation parameters may be associated with the "Build and Turn" mode, and thus the downlink commands 346 may be associated with implementing the specific operation parameter types relevant to that operation mode 350. However, as shown in FIG. 3-2, when the downhole tool is operating in an operation mode 350 of "HIA," a downlink 342 with the same downlink ID 344 of "1-2" may instruct the downhole tool to implement the operation parameters of an increase to the target inclination of 0.5°. Thus, one or more downlink IDs 344 may be applicable across several different operation modes 350 for realizing different changes to the downhole tool dependent on the operation mode 350 in which the downhole tool is operating.

In this way, the downhole tool may be configured to operate in various operation modes and the downhole tool may be instructed how to perform various functions within each operation mode based on a set of downlink definitions for each operation mode. Additionally, downlink IDs 344 that are associated with setting a specific operation mode 350 of the downhole tool may, in some embodiments, not be reused across different operating modes 350 as described, but rather, may be global downlink IDs that, for example, always have the same downlink command 346 and always instruct the downhole tool to implement the associated operation mode 350 regardless of a current operation mode 350. In this way a subset of the downlink IDs 344 may be (e.g., reserved) for setting an operation mode 350 of the downhole tool, and a subset of the downlink IDs 344 (e.g., the remaining downlink IDs 344) may be for implementing specific operation parameters based on a given operation mode 350.

As mentioned above, the downlinks 342 may be transmitted to the downhole tool based on an associated bit pattern 348. For example, a downlink 342 may be encoded into one or more surface parameters (e.g., flow rate, pressure, RPM) supplied at the surface of the wellbore by modulating the surface parameters according to the defined bit pattern 348. The downhole tool may accordingly include sensors and/or componentry for detecting and identifying the bit pattern 348 sent through the modulations of the surface parameters. In some embodiments, the configuration may indicate how to communicate the bit pattern 348 by modulating the surface parameters. For example, bit pattern 348 may be a binary encoding and the configuration may indicate how to modulate the surface parameters in order to encode the bit pattern 348 into the surface parameters. For instance, the configuration may indicate how to implement certain values or changes in values (e.g., psi, RPM, gal/s, etc.) of the surface parameters and for certain time intervals in order to represent the various bits of the bit pattern 348.

In this way, based on a desired operation mode and/or desired operation parameters for the downhole tool to implement, a downlink ID 344 may be selected, and the downlink ID 344 may be communicated to the downhole tool by transmitting a downlink 342 to the downhole tool as a bit pattern 348 encoded into one or more surface parameters. The downhole tool may accordingly detect and interpret the bit pattern 348 into the associated downlink ID 344 in order to implement the associated downlink command 346 for achieving the desired operation mode and/or desired operation parameters.

Figures 1, 4:
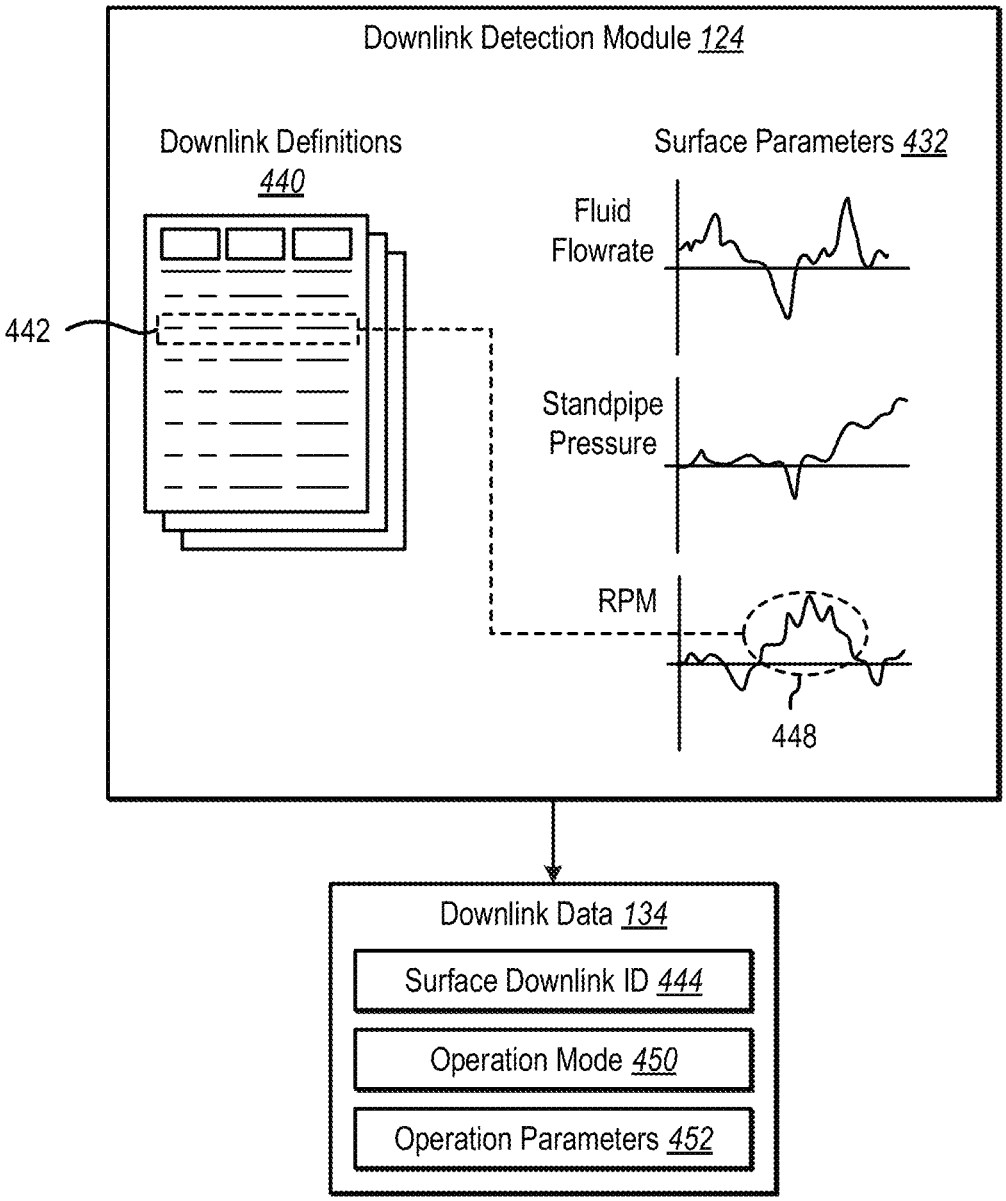
Figures 2, 4:
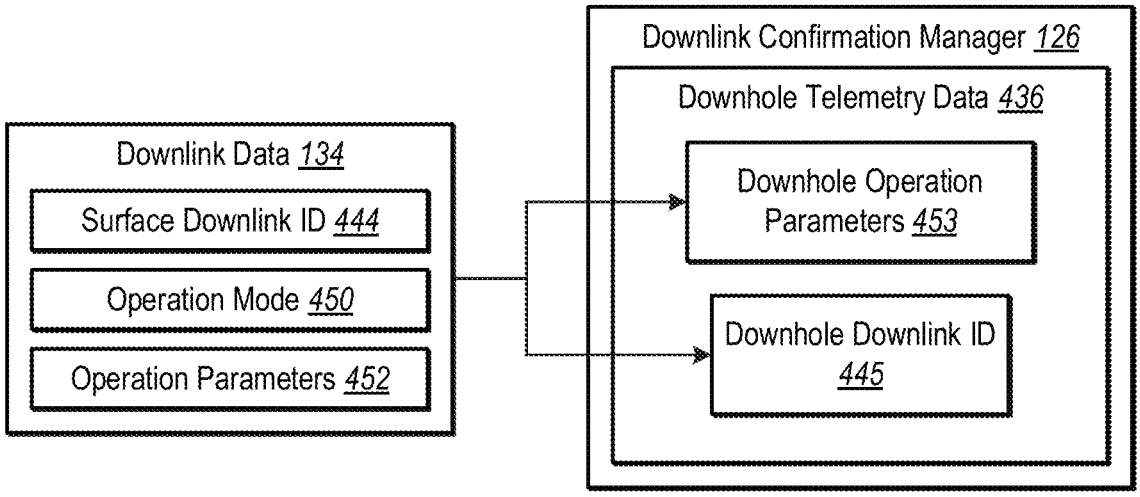

As mentioned above, the status detection system 120 includes a downlink detection module 124. The downlink detection module 124 may facilitate identifying downlinks, and associated information, sent from the surface of the wellbore. FIG. 4-1 illustrates example features and functionality of the downlink detection module 124 as described herein, according to at least one embodiment of the present disclosure.

In some embodiments, the downlink detection module 124 analyzes, reviews, and/or monitors one or more surface parameters 432. For example, the downlink detection module 124 may monitor one or more of a flowrate of a drilling fluid, a standpipe pressure, or a surface RPM, as observed at or near the surface of the wellbore. The downlink detection module 124 may monitor one or more of these surface parameters 432 in order to detect modulations in the surface parameters corresponding to a downlink sent from the surface. For example, as shown in FIG. 4-1, the downlink detection module 124 may identify a bit pattern 448 in the measurement data of the surface parameters 432. The downlink detection module 124 may identify the bit pattern 448 based on a set of downlink definitions 440 which may define a variety of bit patterns for communicating with the downhole tool.

Based on the bit pattern 448, the downlink detection module 124 may identify a surface downlink 442. For example, in view of the downlink definitions 440, the downlink detection module 124 may identify a surface downlink 442 based on an associated bit pattern defined in the downlink definitions 440 corresponding to the surface downlink 442. In this way, the downlink detection module 124 may determine that the surface downlink 442 was sent from the surface of the wellbore.

As mentioned above, the downlink definitions may indicate a variety of information associated with each downlink. In some embodiments, the downlink detection module 124 identifies this information as downlink data 434. For example, the downlink data 434 may identify a surface downlink ID 444 corresponding to the surface downlink 442 identified by the downlink detection module 124. As described herein, the surface downlink ID 444 may be defined in the downlink definitions.

In some embodiments, the downlink data 434 indicates an operation mode 450 associated with the downlink. For example, as described, in some cases a given downlink ID may be associated with different downlink commands based on an operation mode 450 of the downhole tool. Thus, in order to identify what downhole command the surface downlink 442 is intended to convey, the downlink detection module 124 may identify what operation mode it corresponds to. For example, the downlink detection module 124 may call on a (e.g., actively maintained) status of the downhole tool to identify the mode the downhole tool is operating in. In another example, the downlink detection module 124 may identify the operation mode 450 from a previous surface downlink sent (and confirmed as described herein) to the downhole tool. For instance, the downlink detection module may determine that the operation mode 450 is the same as the operation mode determined for a previous downlink, or in instances where a previous downlink instructs the downhole tool to change the operation mode, the downlink detection module 124 may determine the operation mode 450 for the current, surface downlink 442 based on the change in operation mode 450.

In some embodiments, the downlink data 434 indicates operation parameters 452 associated with the surface downlink 442. For example, the downlink detection module 124 may identify, from the downlink definitions 440 (and based on the operation mode as described herein) the operation parameters 452 of the surface downlink 442 for the downhole tool to implement.

In this way, the downlink detection module 124 may generate the downlink data 434, which may indicate various aspects of an expected behavior or expected performance of the downhole tool. The downlink detection module 124 may store the downlink data 434 to the data storage 130. The downlink data 434 may facilitate, as described herein, determining a status of the downhole tool based on inferring that the downhole tool is behaving as expected, or as indicated via the surface downlink 442. The downlink detection module 124 may identify any number of surface downlinks sent from the surface of the wellbore. For example, the downlink detection module 124 may continuously, and in real time, monitor the surface parameters 432 and may identify any number of surface downlinks encoded into the surface parameters. The downlink detection module 124 may accordingly identify and update the downlink data 434 for these detected surface downlinks in real time based on the continuous, real-time monitoring of the surface parameters 432.

As mentioned above, the status detection system 120 includes a downlink confirmation manager 126. The downlink confirmation manager 126 may facilitate confirming the surface downlinks, or confirming that the surface downlinks sent from the surface of the wellbore have been received and/or implemented by the downhole tool. FIG. 4-2 illustrates example features and functionality of the downlink confirmation manager 126 as described herein, according to at least one embodiment of the present disclosure.

In some embodiments, the downlink confirmation manager 126 confirms the surface downlinks based on downhole telemetry data 436. The downhole telemetry data 436 may include and/or may be communicated to the surface as one or more data channels. For example, the downhole telemetry data 436 may include downhole operation parameters 453. The downhole operation parameters 453 may include one or more data channels that may indicate one or more operation parameters that the downhole tool is implementing. For example, the downhole operation parameters 453 may include one or more data channels that may indicate one or more of a downhole toolface angle, a downhole toolface mode, a downhole steering ratio, a downhole target inclination, a downhole inclination nudge size, a downhole target azimuth, a downhole azimuth nudge size, a downhole azimuthal steering ratio, a downhole dog leg severity, a downhole rate of penetration (ROP), or any other operation parameter of the downhole tool, and combinations thereof. In some embodiments, the downhole operation parameters 453 may include a data channel that indicates a downhole operation mode of the downhole tool. In some embodiments, the downhole telemetry data 436 includes a data channel that indicates a downhole downlink ID 445. The downhole downlink ID 445 may be a downlink ID that the downhole tool is currently implementing or acting on. For example, the downlink ID 445 may indicate the last or latest surface downlink that the downhole tool received and implemented. Accordingly, the downlink ID 445 may indicate the associated downlink commands that the downhole tool is currently implementing. In this way, the downhole operation parameters 453 may indicate the settings, parameters, behavior, and/or commands that the downhole tool is or has implemented.

In some embodiments, the downlink confirmation manager 126 confirms the surface downlinks based on verifying the associated downlink data 434 against the downhole telemetry data 436. For example, the downlink confirmation manager 126 may verify that the downhole operation parameters 453 being implemented by the downhole tool are consistent with some or all of the operation parameters 453 of the downhole telemetry data 436. For instance, the operation parameters 452 of the downlink data 434 may indicate that an associated surface downlink has instructed the downhole tool to implement a toolface angle of 75° and a steering ratio of 50%, and the downlink confirmation manager 126 may confirm the surface downlink based on verifying that the downhole operation parameters 453 indicate that the downhole tool is exhibiting a downhole toolface angle of 75° and a downhole steering ratio of 50%. In another example, the downlink confirmation manager 126 may verify that the downhole downlink ID 445 that the downhole tool is implementing is consistent with the surface downlink ID 444 sent from the surface. For example, the surface downlink ID 444 associated with a surface downlink may be "2-5," and the downlink confirmation manager 126 may confirm the surface downlink based on verifying that the downhole tool is operating based on a downhole downlink ID 445 of "2-5." Based on one or more of these comparisons, the downlink confirmation manager 126 may confirm that a surface downlink was received and/or implemented by the downhole tool.

In some embodiments, the downlink confirmation manager 126 confirms the surface downlink based on verifying that all of the downhole operation parameters 453 and the downlink ID 445 match what is indicated in the downlink data 434. This may be possible in instances where the downhole telemetry data 436 is clearly and completely communicated to the surface. In some instances, however, some or all of the downhole telemetry data 436 may not be clearly and/or completely communicated to the surface. For example, in some cases, some or all of the downhole telemetry data 436 may be affected by signal noise or resolution limitations, may not be transmitted from the downhole tool or received at the surface, or may otherwise be unreliable. In such instances, the downlink confirmation manager 126 may confirm the surface downlinks based on some of the downhole telemetry data 436.

For example, in some embodiments, the downlink confirmation manager 126 may verify that the downhole downlink ID 445 matches the surface downlink ID 444, and may accordingly confirm the surface downlink regardless of the downhole operation parameters 453. In another example, the downlink confirmation manager 126 may verify that one or more of the downhole operation parameters 453 agree with one or more of the operation parameters 452 indicated in the downlink data 434, and may accordingly confirm the surface downlink notwithstanding the downhole downlink ID 445 and/or notwithstanding one or more of the other downhole operation parameters 453.

In some embodiments, the downlink confirmation manager 126 may confirm the surface downlink based on determining that a threshold quantity of the downhole telemetry data 436 is in agreeance with the downlink data 434. For example, the downlink confirmation manager 126 may confirm the surface downlink based on 1, 2, 3, or more data channels of the downhole telemetry data 436 indicating data that is consistent with that of the downlink data 434 as described herein (or any other threshold number of data channels). In another example, the downlink confirmation manager 126 may confirm the surface downlink based on one or more data channels of the downhole telemetry data 436 being in agreeance with the associated information of the downlink data 434 for a threshold amount of time.

In another example, the downlink confirmation manager 126 may confirm the surface downlink based on one or more data channels of the downhole telemetry data 436 exhibiting a change of a threshold amount that is in agreeance with the associated downlink data 434. For example, the downhole telemetry data 436 may include data channels representing a target inclination angle and a target azimuth angle. The downhole telemetry data 436 may indicate that the target azimuth angle changed by a certain degree, but the target inclination angle data channel may be incomplete, unreliable, uninterpretable, or may otherwise not be available. The downlink confirmation manager 126 may identify that the change in the target azimuth angle matches the associated operation parameters 452 of the downlink data 434 and may accordingly confirm the surface downlink based on the change in the target azimuth being greater than 3°, greater than 5°, or some other threshold change. Thus, the confirmation manager 126 may verify that the downhole tool is behaving as expected based on the change in one or more verified downhole operation parameters 453 being to such a degree so as to conclude with high confidence that such a change was in response to the associated surface downlink, and not, for example, due to a level of error or variance. The downlink confirmation manager 126 may confirm the downlink in this way solely based on this threshold change, or in combination with other information and/or data channels being agreeance.

In this way, the downlink confirmation manager 126 may confirm the surface downlink based on verifying some or all of the downhole telemetry data 436 with the downlink data 434, or more specifically by verifying, through one or more techniques, that the surface downlink ID 444 and associated downlink command of a surface downlink are being implemented by the downhole tool. The downlink confirmation manager 126 may confirm the surface downlinks in this way in real time, based on the real-time surface data and real-time downlink data 434.

As mentioned above, the status detection system 120 includes a status manager 128. The status manager 128 may determine one or more statuses for the downhole tool. For example, tool status data 138 may be generated and maintained by the status manager 128. The tool status data 138 may indicate a current or active status of the downhole tool. In some cases, the tool status data 138 may indicate one or more previous statuses of the downhole tool, including an initial status. In some embodiments, based on the downlink confirmation manager 126 confirming that the downhole tool received a surface downlink, the status manager 128 may determine a new status and/or may update the current status for the downhole tool indicated in the tool status data. For example, the status manager 128 may determine the downhole tool status (e.g., the operation mode and operation parameters) to be the operation mode 450 and operation parameters 452 indicated in the downlink data 434 and associated with a surface downlink. In other words, the status manager 128 may determine the operation mode and operation parameters that the downhole tool is currently implementing based on the downlink command associated with the surface downlink sent to the downhole tool. The status manager 128 may determine the status in this way based on the downlink confirmation manager 126 confirming that the downhole tool received the surface downlink in order that the status manager 128 may confidently conclude that the downhole tool is behaving in accordance with the downlink commands indicated by the surface downlink.

In some embodiments, the status manager 128 determines the status based on the operation mode 450 and the operation parameters 452 indicated in the downlink data 434 (e.g., which is determined by the downlink detection module 124). In other embodiments, the status manager 128 may independently determine the status. For example, based on the confirmation that the surface downlink was received, the status manager may determine the associated downlink commands that were sent to (and received by) the downhole tool. The status manager 128 may accordingly update the status to reflect the change to the operation mode and/or operation parameters indicated by the downlink command. In some embodiments, the status manager 128 may compare the downlink command to a previous status of the downhole tool in order to determine and update the status. For example, as described herein, some downlink IDs may correspond to different downlink commands for different operating modes. Thus, the status manager 128 may refer to a previous status of the downhole tool to determine an operation mode of the downhole tool in order to determine what downlink commands apply for a given downlink ID, and the status manager 128 may accordingly update the status to reflect the changes indicated by the downlink command it identifies. In another example, as described herein, one or more downlink commands may instruct the downhole tool to change (e.g., increase or decrease) one or more operation parameters by a certain amount or degree. The status manager 128 may accordingly refer to a previous status of the downhole tool to identify the associated operation parameters in order to determine the updated status by incrementing or decrementing the associated operation parameters accordingly. In this way, the status manager 128 may determine, update, and maintain the status of the downhole tool.

In some embodiments, the status manager 128 may determine an initial status of the downhole tool. For instance, in some cases, the tool status data may not indicate one or more previous statuses (e.g., an immediately preceding status). For example, a system error or lack of communication may have affected the status detection process such that a previous status was not determined or recorded. In other examples, the status detection system 120 may need to determine an initial status upon launching or initializing. Further, a substantial period of time may have passed since a previous status was determined such that it may be desirable to determine a new initial status (e.g., notwithstanding a previously recorded status). Thus, in some embodiments, the status manager 128 may determine an initial status as a starting point from which the status detection system 120 may operate as described herein. In some embodiments the status manager 128 may determine an initial status based on the downhole telemetry data. For example, based on the values or measurements of the downhole operation parameters 453, and/or based on the reported downhole downlink ID 445, the status manager may deduce what operation mode and corresponding operation parameters the downhole tool is currently implementing in order to determine the initial status. Determining an initial status in this way may facilitate determining new or updated statuses as described herein.

In some embodiments, the status manager 128 determines and/or updates the status when the downlink confirmation manager 126 does not confirm the surface downlink. For example, in some embodiments, the downlink confirmation manager 126 may identify that communication with the downhole tool in not occurring. For instance, the downlink confirmation manager 126 may identify that the downhole telemetry data 436 is not being transmitted by the downhole tool and/or received at the surface. This loss of communication may be planned, such as to save bandwidth and/or resources, or may be unplanned, such as due to communication issues. In these situations, it may be difficult for the status detection system 120 to identify whether the surface downlinks are being received by the downhole tool, and accordingly determine the status of the downhole tool. In some embodiments, the confirmation manager may not confirm the surface downlinks (e.g., due to lack of downhole telemetry data 436), but may instead indicate to the status detection system 120 to operate in a blind mode.

Based on a determination of a blind mode, the status manager 128 may determine and update the status of the downhole tool based solely on the surface downlinks detected by the downlink detection module 124. For example, in blind mode, it may not be possible to verify that the downhole tool received the surface downlinks, but it may nevertheless be advantageous to know or estimate the behavior, position, orientation, etc., of the downhole tool in order to inform how to continue operation of the downhole tool. The status manager 128 may accordingly update the status based on the surface downlinks even though they have not been confirmed to have been received.

In this way, the status manager 128 may determine and update a current status of the downhole tool. This may facilitate an improved understanding and characterization of how the downhole tool is behaving and performing. For example, by confirming that the downhole tool received a surface downlink as a basis for updating the status, the status detection system 120 may reduce or even eliminate the false detection or incorrect updating of the status, for example, in situations where a surface downlink is sent but the downhole tool does not receive or implement the surface downlink, and thus the downhole tool did not actually change its status.

In some embodiments, the status detection system 120 implements the techniques described herein to determine the current status of the downhole tool in real time, based on the real-time detecting and gathering of the relevant data as described herein. In some embodiments, the status detection system 120 may determine one or more statuses of the downhole tool after that status has been implemented or changed by the downhole tool. For example, as described herein, the downhole tool communicates to the surface through downhole telemetry. In some cases, downhole telemetry techniques may be dependent on one or more surface parameters being implemented. For example, mud pulse telemetry may function based on sending pressure pulses up the wellbore through the drilling fluid in the drill string. If the drilling fluid is not being actively pumped from the surface, however, these mud pulses cannot be transmitted and thus the downhole tool cannot communicate with the surface through this method. In such instances, the status detection system 120 may continue to collect the relevant information described herein in order to determine tool status(es) at a later point. For example, the status detection system 120 may continue identifying surface downlinks and associated downlink data (downlink ID, operation mode, operation parameters, etc.). After the downhole tool is again able to communicate with the surface (e.g., the drilling fluid is again pumped from the surface), the status detection system 120 may receive current and/or past downhole telemetry data from the downhole tool (e.g., downhole operation parameters and/or downhole downlink IDs), and the status detection system 120 may determine one or more past statuses (and when they occurred) based on this downhole telemetry data and the data that the status detection system collected at the surface.

Figure 5:
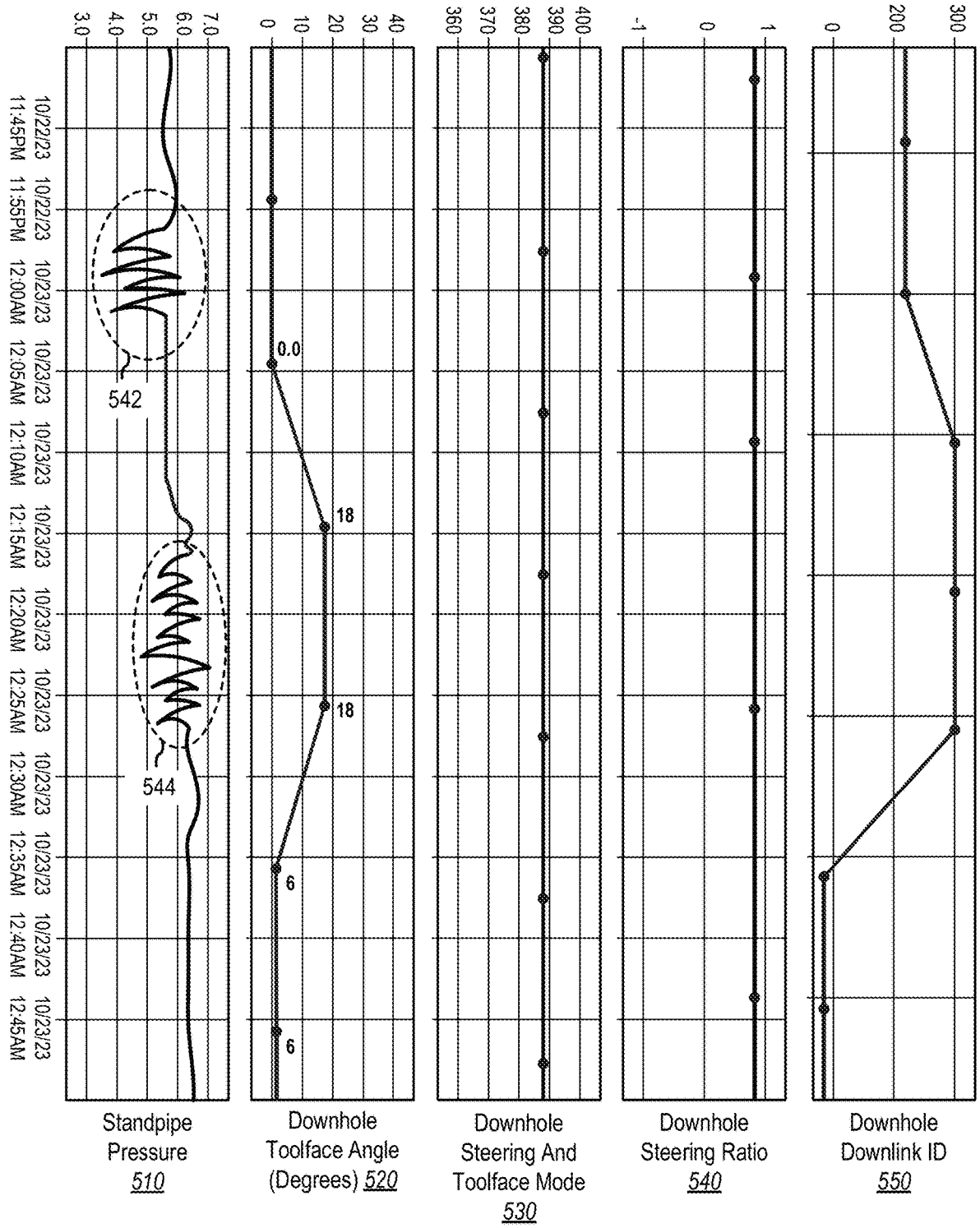
FIG. 5 illustrates example data for demonstrating features and functionality of the status detection system as described herein, according to at least one embodiment of the present disclosure.

FIG. 5 illustrates example data 500 for demonstrating features and functionalities of the status detection system as described herein, according to at least one embodiment of the present disclosure. The example data 500 includes a standpipe pressure 510 observed at the surface of the wellbore, as well as a downhole toolface angle 520, a downhole steering mode and toolface mode 530, a downhole steering ratio 540, and a downhole downlink ID 550, each received at the surface via downhole telemetry techniques. The downhole toolface angle 520 and the downhole steering ratio 540 may indicate a value or measure corresponding to these parameters, such a degrees and percent, respectively. The downhole steering mode and toolface mode 530, as well as the downhole downlink ID 550 may each indicate an integer value that may correspond with a definition for the associated mode or ID, respectively.

As indicated in the standpipe pressure 510, a first surface downlink 542 is identified as having been sent via modulations in the standpipe pressure 510 to the downhole tool. The first surface downlink 542 may correspond with, for example, a downlink command to set the toolface angle to 18° and the steering ratio to 75%. In order to confirm receipt of the first surface downlink 542 by the downhole tool, the status detection system as described herein may compare the first surface downlink 542 (e.g., the operation parameters and operation mode associate with the downlink command of the first surface downlink 542) to information received via one or more data channels from downhole telemetry. As shown, at or shortly after the first surface downlink 542 is sent, the downhole toolface angle 520 is adjusted from 0° to 18°, and the downhole steering ratio 540 is maintained at 75%. Additionally, the downhole downlink ID 550 is adjusted to reflect the current downlink ID being implemented by the downhole tool. Further, the downhole steering mode and toolface mode 530 is not adjusted. Thus, the first surface downlink 542 can be confirmed based on this telemetry data reflecting the changes indicated by the first surface downlink 542.

As another example, a second surface downlink 544 is identified as having been sent via modulations in the standpipe pressure 510 to the downhole tool. The first surface downlink 542 may correspond with, for example, a downlink command to decrease the toolface angle by 12°. As shown, at or shortly after the second surface downlink 544 is sent, the downhole toolface angle 520 is adjusted from 18° to 6°, the downhole steering mode and downhole toolface mode 530 as well as the downhole steering ratio 540 are not adjusted, and the downhole downlink ID 550 is changed to the corresponding integer value. Thus, the second surface downlink 544 can be confirmed based on this telemetry data reflecting the changes indicated by the second surface downlink 544.

Figure 6:
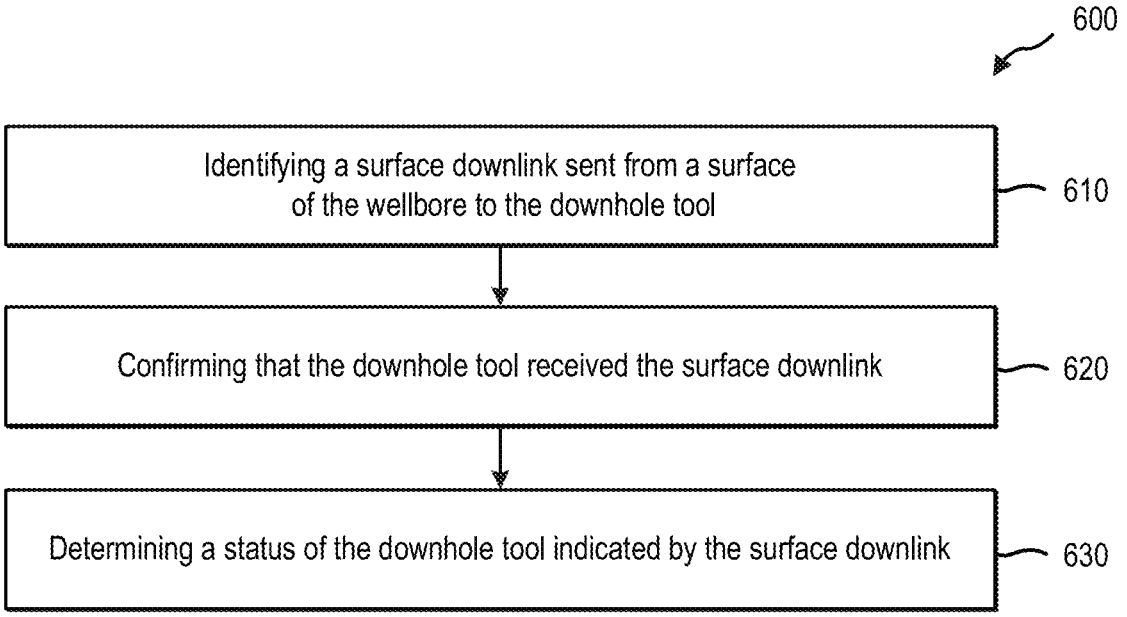
FIG. 6 illustrates a flow diagram for a method or a series of acts for monitoring a downhole tool implemented in a wellbore, according to at least one embodiment of the present disclosure.

FIG. 6 illustrates a flow diagram for a method 600 or a series of acts for monitoring a downhole tool implemented in a wellbore as described herein, according to at least one embodiment of the present disclosure. While FIG. 6 illustrates acts according to one embodiment, alternative embodiments may add to, omit, reorder, or modify any of the acts of FIG. 6.

In some embodiments, the method 600 includes an act 610 of identifying a surface downlink sent from a surface of the wellbore to the downhole tool. In particular, in some embodiments, the act 610 includes identifying, from surface parameters, a surface downlink sent from a surface of the wellbore to the downhole tool, wherein the surface downlink indicates a downlink command for the downhole tool to implement. In some embodiments, an initial status may be received including an initial operation mode and one or more initial operation parameters.

In some embodiments, identifying the downlink includes continuously monitoring the surface parameters to identify a downlink bit pattern. For example, the surface parameters may include one or more of a standpipe pressure, a flow rate, or a rotational speed (RPM) implemented at the surface, and the downlink bit pattern may be encoded into the surface parameters by modulating one or more of the standpipe pressure, the flow rate, or the RPM. In some embodiments, the downhole tool is a steering tool.

In some embodiments, the downlink command of the surface downlink indicates an operation mode for the downhole tool to implement or one or more operation parameters for the downhole tool to implement with respect to a given operation mode. For example, the operation mode may include a manual steering mode, an automatic vertical hold mode, an automatic inclination hold mode, an automatic inclination hold and azimuth hold mode, and an automatic curve mode. The one or more operation parameters may include one or more of a toolface angle, a steering ratio, a target inclination, an inclination nudge size, a target azimuth, an azimuth nudge size, an azimuthal steering ratio, a dog leg severity, or a rate of penetration (ROP).

In some embodiments, the method 600 includes an act 620 of confirming that the downhole tool received the surface downlink. In particular, in some embodiments, the act 620 includes confirming that the downhole tool received the surface downlink based on comparing downhole telemetry data received from the downhole tool to the surface downlink.

In some embodiments, the downhole telemetry data is telemetry data sent to the surface of the wellbore from the downhole tool through one or more of mud pulse telemetry, electromagnetic telemetry, acoustic telemetry, or wired telemetry. For example, the downhole telemetry data may include a data channel indicating a downhole downlink ID. Confirming that the downhole tool received the surface downlink includes comparing the downhole downlink ID to a surface downlink ID of the surface downlink. In some embodiments, the downhole telemetry data includes one or more data channels indicating one or more downhole operation parameters of the downhole tool. Confirming that the downhole tool received the surface downlink may include comparing the one or more downhole operation parameters to one or more updated operation parameters indicated by the surface downlink.

In some embodiments, the method 600 includes an act 630 of determining a status of the downhole tool indicated by the surface downlink. In particular, in some embodiments, the act 630 includes, based on confirming that the downhole tool received the surface downlink, determining a status of the downhole tool indicated by the surface downlink.

In some embodiments, the status of the downhole tool includes an operation mode of the downhole tool. For example, the downhole telemetry data may include one or more data channels for one or more operation parameters of the downhole tool associated with the operation mode, and determining the operation mode may be based on the data channels of the telemetry data. As another example, the operation mode may be determined based on a previous downlink.

In some embodiments, the status of the downhole tool includes one or more operation parameters of the downhole tool. For example, the one or more operation parameters may be determined based on determining an operation mode of the downhole tool and identifying, from a set of downlink definitions for the operation mode, a downlink definition for the downlink that defines the one or more operation parameters for the downhole tool to implement with respect to the operation mode. In some embodiments, the one or more operation parameters may be determined by comparing the operation parameters of the downlink definition to previous operation parameters of the downhole tool indicated by a previous status of the downhole tool. In some embodiments, the operation parameters are steering parameters of the downhole tool.

In some embodiments, the status of the downhole tool may be determined in real time based on identifying the surface downlink in real time and confirming receipt of the surface downlink by the downhole tool in real time. In some embodiments, the method 600 further includes identifying, from surface parameters, a second surface downlink sent from the surface to the downhole tool, indicating a blind mode operation based on determining that the downhole telemetry data is unreliable, and, based on the blind mode operation, determining an updated status of the downhole from the second surface downlink.

Figure 7:
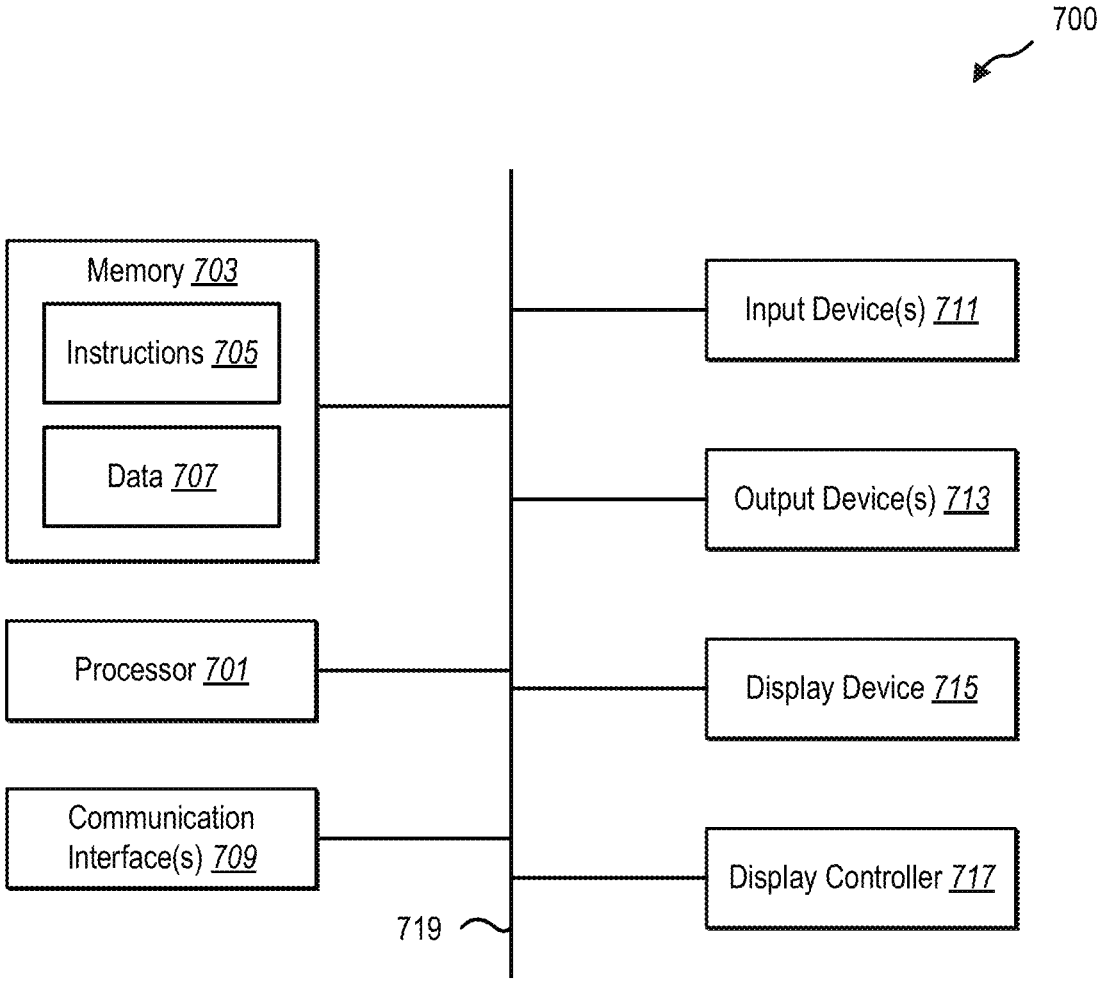
FIG. 7 illustrates certain components that may be included within a computing system.

Turning now to FIG. 7, this figure illustrates certain components that may be included within a computer system 700. One or more computer systems 700 may be used to implement the various devices, components, and systems described herein.

The computer system 700 includes a processor 701. The processor 701 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used.

The computer system 700 also includes memory 703 in electronic communication with the processor 701. The memory 703 may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 709 may connect the computer system 700 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into one or more of text, graphics, or moving images (as appropriate) shown on the display device 715.

The various components of the computer system 700 may be coupled together by one or more buses, which may include one or more of a power bus, a control signal bus, a status signal bus, a data bus, other similar components, or combinations thereof. For the sake of clarity, the various buses are illustrated in FIG. 7 as a bus system 719.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

INDUSTRIAL APPLICABILITY

In some embodiments, a downhole system is described for drilling an earth formation to form a wellbore. The downhole system includes a drill rig used to turn a drilling tool assembly which extends downward into the wellbore. The drilling tool assembly may include a drill string, a bottomhole assembly ("BHA"), and a bit, attached to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. An example BHA may include additional or other downhole drilling tools or components (e.g., coupled between the drill string and the bit). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system may include other downhole drilling tools, components, and accessories such as special valves (e.g., kelly cocks, blowout preventers, and safety valves). Additional components included in the downhole system may be considered a part of the drilling tool assembly the drill string or a part of the BHA, depending on their locations in the downhole system.

The bit in the BHA may be any type of bit suitable for degrading downhole materials. For instance, the bit may be a drill bit suitable for drilling the earth formation. Example types of drill bits used for drilling earth formations are fixed-cutter or drag bits. In other embodiments, the bit may be a mill used for removing metal, composite, elastomer, other materials downhole, or combinations thereof. For instance, the bit may be used with a whipstock to mill into casing lining the wellbore. The bit may also be a junk mill used to mill away tools, plugs, cement, other materials within the wellbore or combinations thereof. Swarf or other cuttings formed by use of a mill may be lifted to the surface or may be allowed to fall downhole. The bit may include one or more cutting elements for degrading the earth formation.

The BHA may further include a rotary steerable system (RSS). The RSS may include directional drilling tools that change a direction of the bit, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit, change the course of the bit, and direct the directional drilling tools on a projected trajectory. The RSS may steer the bit in accordance with or based on a trajectory for the bit. For example, a trajectory may be determined for directing the bit toward one or more subterranean targets such as an oil or gas reservoir.

The downhole system may include or may be associated with one or more client devices with a status detection system implemented thereon (e.g., implemented on one, several, or across multiple client devices). The status detection system may facilitate calculating and/or assessing forces and/or other parameters that may act on the drill string in association with the drill string advancing into or being retrieved from the wellbore.

In some embodiments, a status detection system is implemented in an example environment in accordance with one or more embodiments describe herein. In some embodiments, the example environment includes one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms and/or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via well-site information transfer standard markup language (WITSML) or similar protocol, or any other protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, or function of the downhole system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server device(s) may similarly refer to various types of computing devices. Each of the devices of the environment may include features and/or functionalities described below.

The environment may include a status detection system implemented on one or more computing devices. The status detection system may be implemented on one or more client device, server devices, and combinations thereof. Additionally, or alternatively, the status detection system may be implemented across the client devices and/or the server devices such that different portions or components of the status detection system are implemented on different computing devices in the environment. In this way, the environment may be a cloud computing environment, and the status detection system may be implemented across one or more devices of the cloud computing environment in order to leverage the processing capabilities, memory capabilities, connectivity, speed, etc., that such cloud computing environments offer in order to facilitate the features and functionalities described herein.

In some embodiments, an example implementation of the status detection system is described herein, according to at least one embodiment of the present disclosure. The status detection system may include a data manager, a downhole model engine for generating a downhole model, and a simulation engine. The status detection system may also include a data storage having bit geometry data, operational parameter data, bit behavior characteristics, and formation data stored thereon. While one or more embodiments described herein describe features and functionalities performed by specific components of the status detection system, it will be appreciated that specific features described in connection with one component of the status detection system may, in some examples, be performed by one or more of the other components of the status detection system.

By way of example, one or more of the data receiving, gathering, or storing features of the data manager may be delegated to other components of the status detection system. As another example, while surface downlinks may be confirmed by the downlink confirmation manager, in some instances, some or all of these features may be performed by the downlink detection module (or other component of the status detection system 120). Indeed, it will be appreciated that some or all of the specific components may be combined into other components and specific functions may be performed by one or across multiple components of the status detection system.

Additionally, the status detection system has been described as implemented on a client device of the downhole system, it should be understood that some or all of the features and functionalities of the status detection system may be implemented on or across multiple client devices and/or server devices. For example, data may be input and/or received by the data manager on a (e.g., local) client device, and the downhole model may be generated and/or simulated on one or more of a remote, server, or cloud device. Indeed, it will be appreciated that some or all of the specific components may be implemented on or across multiple client devices and/or server devices, including individual functions of a specific component being performed across multiple devices.

As mentioned above, the status detection system includes a data manager. The data manager may receive a variety of types of data associated with the downhole system and may store the data to the data storage. The data manager may receive the data from a variety of surface and/or downhole sources, such as from sensors, surveying tools, downhole tools, other (e.g., client) devices, libraries, databases, user input, etc.

In some embodiments, the data manager receives surface parameters. The surface parameters may include measurements from surface sensors for various parameters of the downhole system. For example, the surface parameters may include measurements associated with the flow of drilling fluid from the surface such as a standpipe pressure, a flowrate, etc. In another example, the surface parameters include measurements associated with the rotational speed of the drill string applied at the surface, such as a surface rotational speed or surface RPM. The data manager may receive surface parameters for any other parameter. As described herein, the surface parameters may facilitate transmitting downlinks to a downhole tool through bit patterns encoded into the surface parameters. The data manager may store any of this information to the data storage as surface parameters. In some embodiments, the data manager receives and/or stores the surface parameters in real time.

In some embodiments, the downhole tool may be a steering tool, such as an RSS implemented with respect to a BHA of the downhole system. The surface parameters may be supplied to the steering tool in order to facilitate a steering operation of the steering tool, and downlinks may be transmitted to the steering tool through the surface parameters in order to instruct the steering tool how to operate (e.g., to implement steering modes and/or steering parameters). While the status detection system may be primarily described with respect to a steering tool, it should be understood that the techniques described herein may be applicable to any downhole tool for determining a status of the downhole tool based on communications to and from the downhole tool, as described herein.

In some embodiments, the data manager receives downhole telemetry data. The downhole telemetry data may be information transmitted from a downhole tool to the surface. For example, the downhole telemetry data may include one or more data channels for relating measurements and/or other information of the downhole tool to the surface. For instance, the data channels may relate a status of the downhole tool. To elaborate, the data channels may relate a downhole downlink or command received or being executed by the downhole tool. Also, the data channels may relate an operation mode and/or a toolface mode of the downhole tool. In another example, the data channels may relate operation parameters or settings that the downhole tool is implementing, such as a toolface angle, steering ratio, target inclination, inclination nudge size, target azimuth, azimuth nudge size, azimuthal steering ratio, dog leg severity, rate of penetration (ROP), or any other operation parameter of the downhole tool, and combinations thereof. The downhole telemetry data may be transmitted to the surface through downhole telemetry techniques such as mud pulse telemetry, electromagnetic telemetry, acoustic telemetry, or wired telemetry, or any other form of long-distance telemetry, and combinations thereof. The data manager may store any of this information to the data storage as downhole telemetry data. In some embodiments, the data manager receives and/or stores the downhole telemetry data in real time.

In some embodiments, the data manager receives information related to the capabilities of the downhole tool. For example, the data manager may receive or access a configuration or specification of the downhole tool. The configuration may be associated with a specific type, model, manufacturer, and/or firmware of the downhole tool. The configuration may indicate various operation types or operation modes that the downhole tool may implement. The configuration may indicate various operation parameters for the downhole tool to apply for a given operation mode. In one example, the downhole tool may be configured for a manual or "Build and Turn" mode (e.g., manual steering mode). The "Build and Turn" mode may operate based on operation parameters such as one or more of: a toolface mode (e.g., gravity toolface mode, magnetic toolface mode, etc.), a toolface angle (with respect to a coordinate system defined by the toolface mode), or a steering ratio. The "Build and Turn" mode may be a manual or open loop mode in that the downhole tool may not make automatic adjustments or changes, but rather may operate, for example, in accordance with the specific toolface angle and steering ratio indicated by the associated operation parameters.

In various examples, the downhole tool may operate in one or more automatic, or closed-loop modes in which the downhole tool may automatically implement changes or adjustments in accordance with the mode and in accordance with associated operation parameters. In one example, the downhole tool may be configured for an automatic vertical mode in which the downhole tool will automatically maintain a vertical or downward orientation. In another example, the downhole tool may be configured for an automatic "inclination hold" (IH) mode in which the downhole tool may maintain a given inclination. The IH mode may operate based on operation parameters such as one or more of: a target inclination, an inclination nudge size, or an azimuthal steering ratio. In another example, the downhole tool may be configured for an automatic "inclination and azimuth hold" (HIA) mode in which the downhole tool may maintain a given inclination and a given azimuth for tangents and laterals. The "HIA" mode may operate based on operation parameters such as one or more of: a target inclination, an inclination nudge size, a target azimuth, or an azimuth nudge size. In another example, the downhole tool may be configured for an automatic "auto curve" (AC) mode in which the downhole tool may automatically execute a curve of a given size and orientation. The "AC" mode may operate based on operation parameters such as one or more of: a dog leg severity or a toolface mode. In this way, the downhole tool configuration may indicate various operations that the downhole tool can perform based on the various modes in which it can operate. The downhole tool may be configured to implement any other operation mode and may be configured to change between different operation modes.

In some embodiments, the configuration may include instructions for communicating with the downhole tool. For example, the downhole tool may be configured to implement certain operation modes and associated operation parameters based on signals or downlinks received by the downhole tool from the surface. The configuration may include a set of downlink definitions that define various downlinks for transmitting to the downhole tool in order to implement and/or change the operation mode and/or operation parameters of the downhole tool.

In some embodiments, the downhole tool may be configured to communicate via a finite number of discrete, unique downlinks, such as 32 discrete downlinks, 64 discrete downlinks, 128 discrete downlinks, or any other discrete number of downlinks. The downlinks may be identifiable by a unique downlink ID. The downlink ID may be a code or combination of one or more integer numbers that, when received, can be translated (e.g., via the downlink definitions) to indicate an associated downlink command. The downlink command may be a specific set of instructions for the downhole tool to implement, such as implementing one or more specific operation parameters or implementing a given operation mode. A downlink may be communicated to the downhole tool through an associated bit pattern.

In some embodiments, the downlink command for a given downlink may instruct the downhole tool to implement one or more specific operation parameters. For example, a downlink having a downlink ID of "1-1" may indicate to the downhole tool to implement a toolface angle of 0° and a steering ratio of 50%. As another example, a downlink having a downlink ID of "2-3" may indicate to the downhole tool to increase the toolface angle by 6°. A downlink (and associated downlink command) may instruct the downhole tool with respect to any operation parameter for the downhole tool and for any operation mode of the downhole tool. For example, a downlink may instruct the downhole tool to implement a certain inclination angle. As another example, a downlink may instruct the downhole tool to implement a certain dogleg severity. In this way, a downlink may instruct the downhole tool to implement any operation parameters at a specific value, or additionally may indicate to implement a change (e.g., increase or decrease) to any operation parameter and to any degree.

In some embodiments, the downlink command for a given downlink ID may instruct the downhole tool to implement a specific operation mode. For example, a downlink having a downlink ID of "2-20" may indicate to the downhole tool to implement or change to an operation mode of "Build and Turn". A downlink (and associated downlink command) may instruct the downhole tool to implement or change to any operation mode as described herein. For example, a downlink may instruct the downhole tool to change to an operation mode of "IH," "HIA," or "AC," or any other operation mode of the downhole tool. In this way, one or more downlinks may be associated with implementing a specific operation mode.

In some embodiments, one or more downlink commands may be specific to, or may be dependent on, the operation mode of the downhole tool. For example, a given downlink ID may be different for different operating modes. To elaborate, when the downhole tool is operating in an operation mode 350 of "Build and Turn," a downlink with a downlink ID of "1-2" may instruct the downhole tool to implement the operation parameters of a toolface angle of 0° and a steering ratio of 75%. As mentioned above, the toolface angle and steering ratio operation parameters may be associated with the "Build and Turn" mode, and thus the downlink commands may be associated with implementing the specific operation parameter types relevant to that operation mode. However, when the downhole tool is operating in an operation mode of "HIA," a downlink with the same downlink ID of "1-2" may instruct the downhole tool to implement the operation parameters of an increase to the target inclination of 0.5°. Thus, one or more downlink IDs may be applicable across several different operation modes for realizing different changes to the downhole tool dependent on the operation mode in which the downhole tool is operating.

In this way, the downhole tool may be configured to operate in various operation modes and the downhole tool may be instructed how to perform various functions within each operation mode based on a set of downlink definitions for each operation mode. Additionally, downlink IDs that are associated with setting a specific operation mode of the downhole tool may, in some embodiments, not be reused across different operating modes as described, but rather, may be global downlink IDs that, for example, always have the same downlink command and always instruct the downhole tool to implement the associated operation mode regardless of a current operation mode. In this way a subset of the downlink IDs may be (e.g., reserved) for setting an operation mode of the downhole tool, and a subset of the downlink IDs (e.g., the remaining downlink IDs) may be for implementing specific operation parameters based on a given operation mode.

As mentioned above, the downlinks may be transmitted to the downhole tool based on an associated bit pattern. For example, a downlink may be encoded into one or more surface parameters (e.g., flow rate, pressure, RPM) supplied at the surface of the wellbore by modulating the surface parameters according to the defined bit pattern. The downhole tool may accordingly include sensors and/or componentry for detecting and identifying the bit pattern sent through the modulations of the surface parameters. In some embodiments, the configuration may indicate how to communicate the bit pattern by modulating the surface parameters. For example, bit pattern may be a binary encoding and the configuration may indicate how to modulate the surface parameters in order to encode the bit pattern into the surface parameters. For instance, the configuration may indicate how to implement certain values or changes in values (e.g., psi, RPM, gal/s, etc.) of the surface parameters and for certain time intervals in order to represent the various bits of the bit pattern.

In this way, based on a desired operation mode and/or desired operation parameters for the downhole tool to implement, a downlink ID may be selected, and the downlink ID may be communicated to the downhole tool by transmitting a downlink to the downhole tool as a bit pattern encoded into one or more surface parameters. The downhole tool may accordingly detect and interpret the bit pattern into the associated downlink ID in order to implement the associated downlink command for achieving the desired operation mode and/or desired operation parameters.

As mentioned above, the status detection system includes a downlink detection module. The downlink detection module may facilitate identifying downlinks, and associated information, sent from the surface of the wellbore.

In some embodiments, the downlink detection module analyzes, reviews, and/or monitors one or more surface parameters. For example, the downlink detection module may monitor one or more of a flowrate of a drilling fluid, a standpipe pressure, or a surface RPM, as observed at or near the surface of the wellbore. The downlink detection module may monitor one or more of these surface parameters in order to detect modulations in the surface parameters corresponding to a downlink sent from the surface. For example, the downlink detection module may identify a bit pattern in the measurement data of the surface parameters. The downlink detection module may identify the bit pattern based on a set of downlink definitions which may define a variety of bit patterns for communicating with the downhole tool.

Based on the bit pattern, the downlink detection module may identify a surface downlink. For example, in view of the downlink definitions, the downlink detection module may identify a surface downlink based on an associated bit pattern defined in the downlink definitions corresponding to the surface downlink. In this way, the downlink detection module may determine that the surface downlink was sent from the surface of the wellbore.

As mentioned above, the downlink definitions may indicate a variety of information associated with each downlink. In some embodiments, the downlink detection module identifies this information as downlink data. For example, the downlink data may identify a surface downlink ID corresponding to the surface downlink identified by the downlink detection module. As described herein, the surface downlink ID may be defined in the downlink definitions.

In some embodiments, the downlink data indicates an operation mode associated with the downlink. For example, as described, in some cases a given downlink ID may be associated with different downlink commands based on an operation mode of the downhole tool. Thus, in order to identify what downhole command the surface downlink is intended to convey, the downlink detection module may identify what operation mode it corresponds to. For example, the downlink detection module may call on a (e.g., actively maintained) status of the downhole tool to identify the mode the downhole tool is operating in. In another example, the downlink detection module may identify the operation mode from a previous surface downlink sent (and confirmed as described herein) to the downhole tool. For instance, the downlink detection module may determine that the operation mode is the same as the operation mode determined for a previous downlink, or in instances where a previous downlink instructs the downhole tool to change the operation mode, the downlink detection module may determine the operation mode 450 for the current, surface downlink based on the change in operation mode.

In some embodiments, the downlink data indicates operation parameters associated with the surface downlink. For example, the downlink detection module may identify, from the downlink definitions (and based on the operation mode as described herein) the operation parameters of the surface downlink for the downhole tool to implement.

In this way, the downlink detection module may generate the downlink data, which may indicate various aspects of an expected behavior or expected performance of the downhole tool. The downlink detection module may store the downlink data to the data storage. The downlink data may facilitate, as described herein, determining a status of the downhole tool based on inferring that the downhole tool is behaving as expected, or as indicated via the surface downlink. The downlink detection module may identify any number of surface downlinks sent from the surface of the wellbore. For example, the downlink detection module may continuously, and in real time, monitor the surface parameters and may identify any number of surface downlinks encoded into the surface parameters. The downlink detection module may accordingly identify and update the downlink data for these detected surface downlinks in real time based on the continuous, real-time monitoring of the surface parameters.

As mentioned above, the status detection system includes a downlink confirmation manager. The downlink confirmation manager may facilitate confirming the surface downlinks, or confirming that the surface downlinks sent from the surface of the wellbore have been received and/or implemented by the downhole tool.

In some embodiments, the downlink confirmation manager confirms the surface downlinks based on downhole telemetry data. The downhole telemetry data may include and/or may be communicated to the surface as one or more data channels. For example, the downhole telemetry data may include downhole operation parameters. The downhole operation parameters may include one or more data channels that may indicate one or more operation parameters that the downhole tool is implementing. For example, the downhole operation parameters may include one or more data channels that may indicate one or more of a downhole toolface angle, a downhole toolface mode, a downhole steering ratio, a downhole target inclination, a downhole inclination nudge size, a downhole target azimuth, a downhole azimuth nudge size, a downhole azimuthal steering ratio, a downhole dog leg severity, a downhole rate of penetration (ROP), or any other operation parameter of the downhole tool, and combinations thereof. In some embodiments, the downhole operation parameters may include a data channel that indicates a downhole operation mode of the downhole tool. In some embodiments, the downhole telemetry data includes a data channel that indicates a downhole downlink ID. The downhole downlink ID may be a downlink ID that the downhole tool is currently implementing or acting on. For example, the downlink ID may indicate the last or latest surface downlink that the downhole tool received and implemented. Accordingly, the downlink ID may indicate the associated downlink commands that the downhole tool is currently implementing. In this way, the downhole operation parameters may indicate the settings, parameters, behavior, and/or commands that the downhole tool is or has implemented.

In some embodiments, the downlink confirmation manager confirms the surface downlinks based on verifying the associated downlink data against the downhole telemetry data. For example, the downlink confirmation manager may verify that the downhole operation parameters being implemented by the downhole tool are consistent with some or all of the operation parameters of the downhole telemetry data. For instance, the operation parameters of the downlink data may indicate that an associated surface downlink has instructed the downhole tool to implement a toolface angle of 75° and a steering ratio of 50%, and the downlink confirmation manager may confirm the surface downlink based on verifying that the downhole operation parameters indicate that the downhole tool is exhibiting a downhole toolface angle of 75° and a downhole steering ratio of 50%. In another example, the downlink confirmation manager may verify that the downhole downlink ID that the downhole tool is implementing is consistent with the surface downlink ID sent from the surface. For example, the surface downlink ID associated with a surface downlink may be "2-5," and the downlink confirmation manager may confirm the surface downlink based on verifying that the downhole tool is operating based on a downhole downlink ID of "2-5." Based on one or more of these comparisons, the downlink confirmation manager may confirm that a surface downlink was received and/or implemented by the downhole tool.

In some embodiments, the downlink confirmation manager confirms the surface downlink based on verifying that all of the downhole operation parameters and the downlink ID match what is indicated in the downlink data. This may be possible in instances where the downhole telemetry data is clearly and completely communicated to the surface. In some instances, however, some or all of the downhole telemetry data may not be clearly and/or completely communicated to the surface. For example, in some cases, some or all of the downhole telemetry data may be affected by signal noise or resolution limitations, may not be transmitted from the downhole tool or received at the surface, or may otherwise be unreliable. In such instances, the downlink confirmation manager may confirm the surface downlinks based on some of the downhole telemetry data.

For example, in some embodiments, the downlink confirmation manager may verify that the downhole downlink ID matches the surface downlink ID, and may accordingly confirm the surface downlink regardless of the downhole operation parameters. In another example, the downlink confirmation manager may verify that one or more of the downhole operation parameters agree with one or more of the operation parameters indicated in the downlink data, and may accordingly confirm the surface downlink notwithstanding the downhole downlink ID and/or notwithstanding one or more of the other downhole operation parameters.

In some embodiments, the downlink confirmation manager may confirm the surface downlink based on determining that a threshold quantity of the downhole telemetry data is in agreeance with the downlink data. For example, the downlink confirmation manager may confirm the surface downlink based on 1, 2, 3, or more data channels of the downhole telemetry data indicating data that is consistent with that of the downlink data as described herein (or any other threshold number of data channels). In another example, the downlink confirmation manager may confirm the surface downlink based on one or more data channels of the downhole telemetry data being in agreeance with the associated information of the downlink data for a threshold amount of time.

In another example, the downlink confirmation manager may confirm the surface downlink based on one or more data channels of the downhole telemetry data exhibiting a change of a threshold amount that is in agreeance with the associated downlink data. For example, the downhole telemetry data may include data channels representing a target inclination angle and a target azimuth angle. The downhole telemetry data may indicate that the target azimuth angle changed by a certain degree, but the target inclination angle data channel may be incomplete, unreliable, uninterpretable, or may otherwise not be available. The downlink confirmation manager may identify that the change in the target azimuth angle matches the associated operation parameters of the downlink data and may accordingly confirm the surface downlink based on the change in the target azimuth being greater than 3°, greater than 5°, or some other threshold change. Thus, the confirmation manager may verify that the downhole tool is behaving as expected based on the change in one or more verified downhole operation parameters being to such a degree so as to conclude with high confidence that such a change was in response to the associated surface downlink, and not, for example, due to a level of error or variance. The downlink confirmation manager may confirm the downlink in this way solely based on this threshold change, or in combination with other information and/or data channels being agreeance.

In this way, the downlink confirmation manager may confirm the surface downlink based on verifying some or all of the downhole telemetry data with the downlink data, or more specifically by verifying, through one or more techniques, that the surface downlink ID and associated downlink command of a surface downlink are being implemented by the downhole tool. The downlink confirmation manager may confirm the surface downlinks in this way in real time, based on the real-time surface data and real-time downlink data.

As mentioned above, the status detection system includes a status manager. The status manager may determine one or more statuses for the downhole tool. For example, tool status data may be generated and maintained by the status manager. The tool status data may indicate a current or active status of the downhole tool. In some cases, the tool status data may indicate one or more previous statuses of the downhole tool, including an initial status. In some embodiments, based on the downlink confirmation manager confirming that the downhole tool received a surface downlink, the status manager may determine a new status and/or may update the current status for the downhole tool indicated in the tool status data. For example, the status manager may determine the downhole tool status (e.g., the operation mode and operation parameters) to be the operation mode and operation parameters indicated in the downlink data and associated with a surface downlink. In other words, the status manager may determine the operation mode and operation parameters that the downhole tool is currently implementing based on the downlink command associated with the surface downlink sent to the downhole tool. The status manager may determine the status in this way based on the downlink confirmation manager confirming that the downhole tool received the surface downlink in order that the status manager may confidently conclude that the downhole tool is behaving in accordance with the downlink commands indicated by the surface downlink.

In some embodiments, the status manager determines the status based on the operation mode and the operation parameters indicated in the downlink data (e.g., which is determined by the downlink detection module). In other embodiments, the status manager may independently determine the status. For example, based on the confirmation that the surface downlink was received, the status manager may determine the associated downlink commands that were sent to (and received by) the downhole tool. The status manager may accordingly update the status to reflect the change to the operation mode and/or operation parameters indicated by the downlink command. In some embodiments, the status manager may compare the downlink command to a previous status of the downhole tool in order to determine and update the status. For example, as described herein, some downlink IDs may correspond to different downlink commands for different operating modes. Thus, the status manager may refer to a previous status of the downhole tool to determine an operation mode of the downhole tool in order to determine what downlink commands apply for a given downlink ID, and the status manager may accordingly update the status to reflect the changes indicated by the downlink command it identifies. In another example, as described herein, one or more downlink commands may instruct the downhole tool to change (e.g., increase or decrease) one or more operation parameters by a certain amount or degree. The status manager may accordingly refer to a previous status of the downhole tool to identify the associated operation parameters in order to determine the updated status by incrementing or decrementing the associated operation parameters accordingly. In this way, the status manager may determine, update, and maintain the status of the downhole tool.

In some embodiments, the status manager may determine an initial status of the downhole tool. For instance, in some cases, the tool status data may not indicate one or more previous statuses (e.g., an immediately preceding status). For example, a system error or lack of communication may have affected the status detection process such that a previous status was not determined or recorded. In other examples, the status detection system may need to determine an initial status upon launching or initializing. Further, a substantial period of time may have passed since a previous status was determined such that it may be desirable to determine a new initial status (e.g., notwithstanding a previously recorded status). Thus, in some embodiments, the status manager may determine an initial status as a starting point from which the status detection system may operate as described herein. In some embodiments the status manager may determine an initial status based on the downhole telemetry data. For example, based on the values or measurements of the downhole operation parameters, and/or based on the reported downhole downlink ID, the status manager may deduce what operation mode and corresponding operation parameters the downhole tool is currently implementing in order to determine the initial status. Determining an initial status in this way may facilitate determining new or updated statuses as described herein.

In some embodiments, the status manager determines and/or updates the status when the downlink confirmation manager does not confirm the surface downlink. For example, in some embodiments, the downlink confirmation manager may identify that communication with the downhole tool is not occurring. For instance, the downlink confirmation manager may identify that the downhole telemetry data is not being transmitted by the downhole tool and/or received at the surface. This loss of communication may be planned, such as to save bandwidth and/or resources, or may be unplanned, such as due to communication issues. In these situations, it may be difficult for the status detection system to identify whether the surface downlinks are being received by the downhole tool, and accordingly determine the status of the downhole tool. In some embodiments, the confirmation manager may not confirm the surface downlinks (e.g., due to lack of downhole telemetry data), but may instead indicate to the status detection system 120 to operate in a blind mode.

Based on a determination of a blind mode, the status manager may determine and update the status of the downhole tool based solely on the surface downlinks detected by the downlink detection module. For example, in blind mode, it may not be possible to verify that the downhole tool received the surface downlinks, but it may nevertheless be advantageous to know or estimate the behavior, position, orientation, etc., of the downhole tool in order to inform how to continue operation of the downhole tool. The status manager may accordingly update the status based on the surface downlinks even though they have not been confirmed to have been received.

In this way, the status manager may determine and update a current status of the downhole tool. This may facilitate an improved understanding and characterization of how the downhole tool is behaving and performing. For example, by confirming that the downhole tool received a surface downlink as a basis for updating the status, the status detection system may reduce or even eliminate the false detection or incorrect updating of the status, for example, in situations where a surface downlink is sent but the downhole tool does not receive or implement the surface downlink, and thus the downhole tool did not actually change its status.

In some embodiments, the status detection system implements the techniques described herein to determine the current status of the downhole tool in real time, based on the real-time detecting and gathering of the relevant data as described herein. In some embodiments, the status detection system may determine one or more statuses of the downhole tool after that status has been implemented or changed by the downhole tool. For example, as described herein, the downhole tool communicates to the surface through downhole telemetry. In some cases, downhole telemetry techniques may be dependent on one or more surface parameters being implemented. For example, mud pulse telemetry may function based on sending pressure pulses up the wellbore through the drilling fluid in the drill string. If the drilling fluid is not being actively pumped from the surface, however, these mud pulses cannot be transmitted and thus the downhole tool cannot communicate with the surface through this method. In such instances, the status detection system may continue to collect the relevant information described herein in order to determine tool status(es) at a later point. For example, the status detection system may continue identifying surface downlinks and associated downlink data (downlink ID, operation mode, operation parameters, etc.). After the downhole tool is again able to communicate with the surface (e.g., the drilling fluid is again pumped from the surface), the status detection system 120 may receive current and/or past downhole telemetry data from the downhole tool (e.g., downhole operation parameters and/or downhole downlink IDs), and the status detection system may determine one or more past statuses (and when they occurred) based on this downhole telemetry data and the data that the status detection system collected at the surface.

In some embodiments, features and functionalities of the status detection system are described herein with respect to example data. The example data includes a standpipe pressure observed at the surface of the wellbore, as well as a downhole toolface angle, a downhole steering mode and toolface mode, a downhole steering ratio, and a downhole downlink ID, each received at the surface via downhole telemetry techniques. The downhole toolface angle and the downhole steering ratio may indicate a value or measure corresponding to these parameters, such a degrees and percent, respectively. The downhole steering mode and toolface mode, as well as the downhole downlink ID may each indicate an integer value that may correspond with a definition for the associated mode or ID, respectively.

As indicated in the standpipe pressure, a first surface downlink is identified as having been sent via modulations in the standpipe pressure to the downhole tool. The first surface downlink may correspond with, for example, a downlink command to set the toolface angle to 18° and the steering ratio to 75%. In order to confirm receipt of the first surface downlink by the downhole tool, the status detection system as described herein may compare the first surface downlink (e.g., the operation parameters and operation mode associated with the downlink command of the first surface downlink) to information received via one or more data channels from downhole telemetry. As shown, at or shortly after the first surface downlink is sent, the downhole toolface angle is adjusted from 0° to 18°, and the downhole steering ratio is maintained at 75%. Additionally, the downhole downlink ID is adjusted to reflect the current downlink ID being implement by the downhole tool. Further, the downhole steering mode and toolface mode is not adjusted. Thus, the first surface downlink can be confirmed based on this telemetry data reflecting the changes indicated by the first surface downlink.

As another example, a second surface downlink is identified as having been sent via modulations in the standpipe pressure to the downhole tool. The first surface downlink may correspond with, for example, a downlink command to decrease the toolface angle by 12°. As shown, at or shortly after the second surface downlink is sent, the downhole toolface angle is adjusted from 18° to 6°, the downhole steering mode and downhole toolface mode as well as the downhole steering ratio are not adjusted, and the downhole downlink ID is changed to the corresponding integer value. Thus, the second surface downlink can be confirmed based on this telemetry data reflecting the changes indicated by the second surface downlink.

In some embodiments, a method or a series of acts for monitoring a downhole tool implemented in a wellbore is described herein, according to at least one embodiment of the present disclosure.

In some embodiments, the method includes an act of identifying a surface downlink sent from a surface of the wellbore to the downhole tool. In particular, in some embodiments, the act includes identifying, from surface parameters, a surface downlink sent from a surface of the wellbore to the downhole too, wherein the surface downlink indicates a downlink command for the downhole tool to implement. In some embodiments, an initial status may be received including an initial operation mode and one or more initial operation parameters.

In some embodiments, identifying the downlink includes continuously monitoring the surface parameters to identify a downlink bit pattern. For example, the surface parameters may include one or more of a standpipe pressure, a flow rate, or a rotational speed (RPM) implemented at the surface, and the downlink bit pattern may be encoded into the surface parameters by modulating one or more of the standpipe pressure, the flow rate, or the RPM. In some embodiments, the downhole tool is a steering tool.

In some embodiments, the downlink command of the surface downlink indicates an operation mode for the downhole tool to implement or one or more operation parameters for the downhole tool to implement with respect to a given operation mode. For example, the operation mode may include a manual steering mode, an automatic vertical hold mode, an automatic inclination hold mode, an automatic inclination hold and azimuth hold mode, and an automatic curve mode. The one or more operation parameters may include one or more of a toolface angle, a steering ratio, a target inclination, an inclination nudge size, a target azimuth, an azimuth nudge size, an azimuthal steering ratio, a dog leg severity, or a rate of penetration (ROP).

In some embodiments, the method includes an act of confirming that the downhole tool received the surface downlink. In particular, in some embodiments, the act 620 includes confirming that the downhole tool received the surface downlink based on comparing downhole telemetry data received from the downhole tool to the surface downlink.

In some embodiments, the downhole telemetry data is telemetry data sent to the surface of the wellbore from the downhole tool through one or more of mud pulse telemetry, electromagnetic telemetry, acoustic telemetry, or wired telemetry. For example, the downhole telemetry data may include a data channel indicating a downhole downlink ID. Confirming that the downhole tool received the surface downlink includes comparing the downhole downlink ID to a surface downlink ID of the surface downlink. In some embodiments, the downhole telemetry data includes one or more data channels indicating one or more downhole operation parameters of the downhole tool. Confirming that the downhole tool received the surface downlink may include comparing the one or more downhole operation parameters to one or more updated operation parameters indicated by the surface downlink.

In some embodiments, the method includes an act of determining a status of the downhole tool indicated by the surface downlink. In particular, in some embodiments, the act includes, based on confirming that the downhole tool received the surface downlink, determining a status of the downhole tool indicated by the surface downlink.

In some embodiments, the status of the downhole tool includes an operation mode of the downhole tool. For example, the downhole telemetry data may include one or more data channels for one or more operation parameters of the downhole tool associated with the operation mode, and determining the operation mode may be based on the data channels of the telemetry data. As another example, the operation mode may be determined based on a previous downlink.

In some embodiments, the status of the downhole tool includes one or more operation parameters of the downhole tool. For example, the one or more operation parameters may be determined based on determining an operation mode of the downhole tool and identifying, from a set of downlink definitions for the operation mode, a downlink definition for the downlink that defines the one or more operation parameters for the downhole tool to implement with respect to the operation mode. In some embodiments, the one or more operation parameters may be determined by comparing the operation parameters of the downlink definition to previous operation parameters of the downhole tool indicated by a previous status of the downhole tool. In some embodiments, the operation parameters are steering parameters of the downhole tool.

In some embodiments, the status of the downhole tool may be determined in real time based on identifying the surface downlink in real time and confirming receipt of the surface downlink by the downhole tool in real time. In some embodiments, the method 600 further includes identifying, from surface parameters, a second surface downlink sent from the surface to the downhole tool, indicating a blind mode operation based on determining that the downhole telemetry data is unreliable, and, based on the blind mode operation, determining an updated status of the downhole from the second surface downlink.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is described, in an alternative configuration, a combination of processors (e.g., an ARM and DSP) could be used.

The computer system also includes memory in electronic communication with the processor. The memory may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into one or more of text, graphics, or moving images (as appropriate) shown on the display device.

The various components of the computer system may be coupled together by one or more buses, which may include one or more of a power bus, a control signal bus, a status signal bus, a data bus, other similar components, or combinations thereof.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

The following description from ¶¶ [0170]-[0189] includes various embodiments that, where feasible, may be combined in any permutation. For example, the embodiment of ¶ [0170] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a method of monitoring a downhole tool implemented in a wellbore includes identifying, from surface parameters, a surface downlink sent from a surface of the wellbore to the downhole tool. The surface downlink indicates a downlink command for the downhole tool to implement. The method further includes confirming that the downhole tool received the surface downlink based on comparing downhole telemetry data received from the downhole tool to the surface downlink. The method further includes, based on confirming that the downhole tool received the surface downlink, determining a status of the downhole tool indicated by the surface downlink.

In some embodiments, the surface parameters include one or more of a standpipe pressure, a flow rate, or a rotational speed (RPM) implemented at the surface, and identifying the surface downlink includes receiving a downlink bit pattern encoded into the surface parameters by modulating one or more of the standpipe pressure, the flow rate, or the RPM.

In some embodiments, identifying the surface downlink includes continuously monitoring the surface parameters to identify the downlink bit pattern.

In some embodiments, the downhole telemetry data is telemetry data sent to the surface of the wellbore from the downhole tool through one or more of mud pulse telemetry, electromagnetic telemetry, acoustic telemetry, or wired telemetry.

In some embodiments, determining the status of the downhole tool includes determining an operation mode of the downhole tool.

In some embodiments, the downhole telemetry data includes one or more data channels for one or more operation parameters of the downhole tool associated with the operation mode, and determining the operation mode is based on the one or more data channels of the downhole telemetry data.

In some embodiments, determining the operation mode is based on a previous downlink.

In some embodiments, determining the status of the downhole tool includes determining one or more operation parameters of the downhole tool.

In some embodiments, determining the one or more operation parameters includes determining an operation mode of the downhole tool and identifying, from a set of downlink definitions for the operation mode, a downlink definition for the surface downlink that defines the one or more operation parameters for the downhole tool to implement with respect to the operation mode.

In some embodiments, determining the one or more operation parameters includes comparing the one or more operation parameters of the downlink definition to previous operation parameters of the downhole tool indicated by a previous status of the downhole tool.

In some embodiments, the downhole tool is a steering tool and determining the status includes determining a steering mode and associated steering parameters of the steering tool.

In some embodiments, the downhole telemetry data includes a data channel indicating a downhole downlink ID, and wherein confirming that the downhole tool received the surface downlink includes comparing the downhole downlink ID to a surface downlink ID of the surface downlink.

In some embodiments, the downlink command of the surface downlink indicates an operation mode for the downhole tool to implement, or one or more operation parameters for the downhole tool to implement with respect to a given operation mode.

In some embodiments, the operation mode includes a manual steering mode, an automatic vertical hold mode, an automatic inclination hold mode, an automatic inclination hold and azimuth hold mode, and an automatic curve mode.

In some embodiments, the one or more operation parameters includes one or more of a toolface angle, a steering ratio, a target inclination, an inclination nudge size, a target azimuth, an azimuth nudge size, an azimuthal steering ratio, a dog leg severity, or a rate of penetration (ROP).

In some embodiments, the surface downlink indicates for the downhole tool to implement one or more updated operation parameters, and the downhole telemetry data includes one or more data channels indicating one or more downhole operation parameters of the downhole tool, and wherein confirming that the downhole tool received the surface downlink includes comparing the one or more downhole operation parameters to the one or more updated operation parameters indicated by the surface downlink.

In some embodiments, the method further includes determining the status of the downhole tool in real time based on identifying the surface downlink in real time and confirming receipt of the surface downlink by the downhole tool in real time.

In some embodiments, the method further includes identifying, from surface parameters, a second surface downlink sent from the surface to the downhole tool, indicating a blind mode operation based on determining that the downhole telemetry data is unreliable, and, based on the blind mode operation, determining an updated status of the downhole tool from the second surface downlink.

In some embodiments, a method of monitoring a downhole tool implemented in a wellbore includes receiving an initial status of the downhole tool including an initial operation mode and one or more initial operation parameters. The method further includes identifying, from surface parameters, a surface downlink sent from a surface of the wellbore to the downhole tool. The surface downlink indicates a downlink command for the downhole tool to change the initial status. The method further includes confirming that the downhole tool received the surface downlink based on comparing the surface downlink to downhole telemetry data received at the surface from the downhole tool. The method further includes, based on the confirmation, determining an updated status of the downhole tool including updating one or more of the initial operation mode or the one or more initial operation parameters of the initial status based on the downlink command indicated in the surface downlink.

In some embodiments, a method of monitoring a downhole tool implemented in a wellbore includes receiving downhole telemetry data received at a surface of the wellbore from the downhole tool, including one or more data channels indicating operation parameters for the downhole tool. The method further includes determining an initial status of the downhole tool, including an initial operation mode implemented by the downhole tool and one or more initial operation parameters implemented by the downhole tool for the initial operation mode, based on the downhole telemetry data. The method further includes identifying a surface downlink encoded into surface parameters sent from a surface of the wellbore to the downhole tool, wherein the surface downlink indicates a downlink command for the downhole tool to change the initial operation mode or to change the one or more initial operation parameters. The method further includes confirming that the downhole tool received the surface downlink based on comparing the downhole telemetry data to the surface downlink, including, confirming that the downhole tool received the surface downlink includes verifying a downhole downlink ID data channel of the downhole telemetry data with a surface downlink ID of the surface downlink, and verifying one or more operation parameter data channels of the downhole telemetry data with the downlink command of the surface downlink. The method further includes, based on the confirmation, determining an updated status of the downhole tool including updating one or more of the initial operation mode or the one or more initial operation parameters based on the downlink command indicated in the surface downlink.

The embodiments of the status detection system have been primarily described with reference to wellbore drilling operations; the status detection system described herein may be used in applications other than the drilling of a wellbore. In other embodiments, the status detection system according to the present disclosure may be used outside a wellbore or other downhole environment used for the exploration or production of natural resources. For instance, the status detection system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers'specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of monitoring a downhole tool implemented in a wellbore, comprising:

receiving a status of the downhole tool indicating an operation mode and one or more operation parameters for the downhole tool, wherein the status indicates that the operation mode is a first operation mode, and wherein the operation mode of the downhole tool relates to the downhole tool performing downhole operations based on the one or more operation parameters;

identifying a plurality of sets of downlink definitions for which the downhole tool is configured to communicate, the plurality of sets of downlink definitions including:

a first set of downlink definitions that define, for a set of downlink identifiers (IDs), a first set of downlink commands for the first operation mode of the downhole tool, wherein the first operation mode is associated with performing a first downhole operation with the downhole tool; and a second set of downlink definitions that define, for the set of downlink IDs, a second set of downlink commands for a second operation mode of the downhole tool, the second set of downlink commands being different than the first set of downlink commands, wherein the second operation mode is associated with performing a second downhole operation with the downhole tool;

identifying a first downlink ID for sending from a surface of the wellbore to the downhole tool that indicates a first downlink command for the downhole tool to change the operation mode from the first operation mode to the second operation mode;

transmitting the first downlink ID as a first surface downlink from the surface of the wellbore to the downhole tool by modulating one or more surface parameters;

identifying, from the second set of downlink definitions, a target downlink ID of the set of downlink IDs for sending from the surface of the wellbore to the downhole tool, the target downlink ID indicating a target downlink command for the downhole tool to implement for performing the second downhole operation, wherein, in the first set of downlink definitions, the target downlink ID indicates a different downlink command for the first operation mode than the target downlink command for the second operation mode; and transmitting the target downlink ID as a target surface downlink from the surface of the wellbore to the downhole tool by modulating the one or more surface parameters.

2. The method of claim 1, further comprising implementing the target downlink command at the downhole tool and performing the second downhole operation, based on receiving the target downlink ID and based on the downhole tool operating in the second operation mode.

3. The method of claim 1, further comprising, while the downhole tool is operating in the first operation mode and prior to transmitting the first downlink ID to change the operation mode of the downhole tool to the second operation mode:

transmitting the target downlink ID to the downhole tool; and implementing the different downlink command at the downhole tool to perform the first downhole operation, based on the downhole tool receiving the target downlink ID and based on the downhole tool operating in the first operation mode.

4. The method of claim 1, wherein the one or more surface parameters include one or more of a standpipe pressure, a flow rate, or a rotational speed (RPM) implemented at the surface.

5. The method of claim 4, wherein each downlink ID of the set of downlink IDs is further defined, via the first set of downlink definitions and the second set of downlink definitions, by an associated bit pattern for transmitting said each downlink ID of the set of downlink IDs based on the modulating of the one or more surface parameters to encode the associated bit pattern.

6. The method of claim 1, further comprising receiving downhole telemetry data and determining the status of the downhole tool based on the downhole telemetry data, including determining the operation mode implemented by the downhole tool and determining the one or more operation parameters implemented by the downhole tool for the operation mode.

7. The method of claim 6, wherein the downhole telemetry data is telemetry data sent to the surface of the wellbore from the downhole tool through one or more of mud pulse telemetry, electromagnetic telemetry, acoustic telemetry, or wired telemetry.

8. The method of claim 6, further comprising determining that the downhole tool received the target surface downlink based on the downhole telemetry data.

9. The method of claim 8, further comprising confirming that the downhole tool received the target surface downlink based on comparing the one or more operation parameters to the target downlink command.

10. The method of claim 8, wherein the downhole telemetry data includes a downlink ID data channel, and further comprising determining that the downhole tool received the target surface downlink based on comparing the downlink ID data channel to the target downlink ID.

11. The method of claim 1, wherein the downhole tool is a steering tool, wherein the first operation mode and the second operation mode are steering modes of the downhole tool, and wherein the first set of downlink commands and the second set of downlink commands are steering commands of the downhole tool.

12. The method of claim 11, further comprising, based on receiving the target downlink ID, implementing the target downlink command at the downhole tool to steer the downhole tool.

13. The method of claim 1, wherein each set of downlink definitions of the plurality of sets of downlink definitions defines a global subset of downlink IDs of the set of downlink IDs associated with a global set of downlink commands that are same across said each set of downlink definitions of the plurality of sets of downlink definitions.

14. The method of claim 13, wherein the global set of downlink commands are associated with changing the operation mode of the downhole tool.

15. The method of claim 13, wherein the first downlink ID transmitted to the downhole tool is included in the global subset of downlink IDs and the first downlink command is included in the global set of downlink commands.

16. A system for operating a downhole tool implemented in a wellbore comprising:

a processor;

memory accessible by the processor; and processor-executable instructions stored in the memory and executable to instruct the system to perform operations of:

receiving a status of the downhole tool indicating an operation mode and one or more operation parameters for the downhole tool, wherein the status indicates that the operation mode is a first operation mode, and wherein the operation mode of the downhole tool relates to the downhole tool performing downhole operations based on the one or more operation parameters;

identifying a plurality of sets of downlink definitions for which the downhole tool is configured to communicate, the plurality of sets of downlink definitions including:

a first set of downlink definitions that define, for a set of downlink identifiers (IDs), a first set of downlink commands for the first operation mode of the downhole tool, wherein the first operation mode is associated with performing a first downhole operation with the downhole tool; and a second set of downlink definitions that define, for the set of downlink IDs, a second set of downlink commands for a second operation mode of the downhole tool, the second set of downlink commands being different than the first set of downlink commands, wherein the second operation mode is associated with performing a second downhole operation with the downhole tool;

identifying a first downlink ID for sending from a surface of the wellbore to the downhole tool that indicates a first downlink command for the downhole tool to change the operation mode from the first operation mode to the second operation mode;

transmitting the first downlink ID as a first surface downlink from the surface of the wellbore to the downhole tool by modulating one or more surface parameters;

identifying, from the second set of downlink definitions, a target downlink ID of the set of downlink IDs for sending from the surface of the wellbore to the downhole tool, the target downlink ID indicating a target downlink command for the downhole tool to implement for performing the second downhole operation, wherein, in the first set of downlink definitions, the target downlink ID indicates a different downlink command for the first operation mode than the target downlink command for the second operation mode; and transmitting the target downlink ID as a target surface downlink from the surface of the wellbore to the downhole tool by modulating the one or more surface parameters.

17. The system of claim 16, further comprising implementing the target downlink command at the downhole tool and performing the second downhole operation, based on receiving the target downlink ID and based on the downhole tool operating in the second operation mode.

18. The system of claim 16, wherein the downhole tool is a steering tool, wherein the first operation mode and the second operation mode are steering modes of the downhole tool, and wherein the first set of downlink commands and the second set of downlink commands are steering commands of the downhole tool.

19. A non-transitory computer-readable storage medium storing instructions that when executed by a computer, which includes a processor, performs a method, the method comprising:

receiving a status of a downhole tool indicating an operation mode and one or more operation parameters for the downhole tool, wherein the status indicates that the operation mode is a first operation mode, and wherein the operation mode of the downhole tool relates to the downhole tool performing downhole operations based on the one or more operation parameters;

identifying a plurality of sets of downlink definitions for which the downhole tool is configured to communicate, the plurality of sets of downlink definitions including:

a first set of downlink definitions that define, for a set of downlink identifiers (IDs), a first set of downlink commands for the first operation mode of the downhole tool, wherein the first operation mode is associated with performing a first downhole operation with the downhole tool; and a second set of downlink definitions that define, for the set of downlink IDs, a second set of downlink commands for a second operation mode of the downhole tool, the second set of downlink commands being different than the first set of downlink commands, wherein the second operation mode is associated with performing a second downhole operation with the downhole tool;

identifying a first downlink ID for sending from a surface of a wellbore within which the downhole tool is implemented to the downhole tool that indicates a first downlink command for the downhole tool to change the operation mode from the first operation mode to the second operation mode;

transmitting the first downlink ID as a first surface downlink from the surface of the wellbore to the downhole tool by modulating one or more surface parameters;

identifying, from the second set of downlink definitions, a target downlink ID of the set of downlink IDs for sending from the surface of the wellbore to the downhole tool, the target downlink ID indicating a target downlink command for the downhole tool to implement for performing the second downhole operation, wherein, in the first set of downlink definitions, the target downlink ID indicates a different downlink command for the first operation mode than the target downlink command for the second operation mode; and transmitting the target downlink ID as a target surface downlink from the surface of the wellbore to the downhole tool by modulating the one or more surface parameters.

20. The non-transitory computer-readable storage medium of claim 19, further comprising: while the downhole tool is operating in the first operation mode and prior to transmitting the first downlink ID to change the operation mode of the downhole tool to the second operation mode:

transmitting the target downlink ID to the downhole tool; and implementing the different downlink command at the downhole tool to perform the first downhole operation, based on the downhole tool receiving the target downlink ID and based on the downhole tool operating in the first operation mode; and after transmitting the first downlink ID and while the downhole tool is operating in the second operation mode, implementing the target downlink command at the downhole tool and performing the second downhole operation, based on receiving the target downlink ID and based on the downhole tool operating in the second operation mode.

* * * * *